US011287191B2

(12) United States Patent
Aaron et al.

(10) Patent No.: US 11,287,191 B2
(45) Date of Patent: Mar. 29, 2022

(54) HEAT EXCHANGER HAVING PLUME ABATEMENT ASSEMBLY BYPASS

(71) Applicant: Baltimore Aircoil Company, Inc., Jessup, MD (US)

(72) Inventors: David Andrew Aaron, Reisterstown, MD (US); Nikhin Herbert Mascarenhas, Columbia, MD (US)

(73) Assignee: Baltimore Aircoil Company, Inc., Jessup, MD (US)

( * ) Notice: Subject to any disclaimer, the term of this patent is extended or adjusted under 35 U.S.C. 154(b) by 0 days.

(21) Appl. No.: 16/824,168

(22) Filed: Mar. 19, 2020

(65) Prior Publication Data

US 2020/0300553 A1 Sep. 24, 2020

Related U.S. Application Data

(60) Provisional application No. 62/820,546, filed on Mar. 19, 2019.

(51) Int. Cl.
*F28D 15/00* (2006.01)
*F28D 15/02* (2006.01)

(52) U.S. Cl.
CPC ..... *F28D 15/02* (2013.01)

(58) Field of Classification Search
CPC ..... F28D 15/02
(Continued)

(56) References Cited

U.S. PATENT DOCUMENTS 3,367,413 A 2/1968 Forster
3,754,738 A 8/1973 Blazer
(Continued)

FOREIGN PATENT DOCUMENTS

CA 2808810 9/2013
DE 3030439 A1 3/1982
(Continued)

OTHER PUBLICATIONS

Baltimore Aircoil Company; Chapter 15: Plume Abatement; pp. 87-88; publicly available before Mar. 19, 2019; 2 pages.
(Continued)

*Primary Examiner* — Davis D Hwu
(74) *Attorney, Agent, or Firm* — Fitch, Even, Tabin & Flannery LLP

(57) ABSTRACT

In one aspect, a heat exchange apparatus is provided that includes an evaporative heat exchanger assembly including an evaporative heat exchanger and an evaporative liquid distribution assembly configured to distribute evaporative liquid onto the evaporative heat exchanger. The heat exchange apparatus includes a plume abatement assembly downstream of the evaporative heat exchanger. The plume abatement assembly includes at least one heating element configured to increase the temperature of the airflow from the evaporative heat exchanger before the airflow leaves the heat exchange apparatus. The plume abatement assembly has an operative configuration wherein the airflow travels through the at least one heating element to permit the at least one heating element to raise the temperature of the airflow and a bypass configuration wherein less of the airflow travels through the at least one heating element of the plume abatement assembly.

36 Claims, 20 Drawing Sheets

(58) Field of Classification Search
USPC ..... 165/104.21
See application file for complete search history.

(56) References Cited

U.S. PATENT DOCUMENTS 3,923,935 A * 12/1975 Cates ..... F28C 1/14 261/159
3,998,394 A 12/1976 Ovard
4,028,440 A 6/1977 Engalitcheff, Jr.
4,076,771 A 2/1978 Houx, Jr.
4,418,023 A 11/1983 Dolan
4,637,225 A 1/1987 Marshall
4,662,902 A 5/1987 Meyer-Pittroff
5,226,285 A 7/1993 Dankowski
5,273,687 A 12/1993 Osborne
5,431,858 A 7/1995 Harrison, Jr.
5,435,382 A 7/1995 Carter
5,449,036 A 9/1995 Genge
5,585,047 A 12/1996 Mortensen
5,724,828 A 3/1998 Korenic
5,775,409 A 7/1998 Goto
5,816,315 A 10/1998 Stark
5,816,318 A 10/1998 Carter
5,944,094 A * 8/1999 Kinney, Jr ..... F28C 1/14 165/166
5,994,094 A 11/1999 Hoetten
6,047,555 A 4/2000 Weng
6,142,219 A 11/2000 Korenic
6,213,200 B1 4/2001 Carter
6,260,830 B1 7/2001 Harrison
6,427,461 B1 8/2002 Whinery
6,446,941 B1 9/2002 Maheshwari
6,564,864 B2 5/2003 Carter
6,574,980 B1 6/2003 Morrison
6,684,943 B2 2/2004 Dobbs
7,107,782 B2 9/2006 Carter
7,128,310 B2 10/2006 Mockry
7,310,958 B2 12/2007 Carter
7,484,718 B2 2/2009 Facius
7,603,774 B2 10/2009 Facius
7,802,774 B2 9/2010 Facius
8,412,357 B2 4/2013 Seem
8,434,746 B2 5/2013 Carter
8,483,883 B1 7/2013 Watson
8,676,385 B2 3/2014 Myers
8,833,741 B2 9/2014 Mockry
9,004,463 B2 4/2015 Carter
9,057,563 B2 6/2015 Carter
9,057,564 B2 6/2015 Carter
9,182,753 B2 11/2015 Benosman
9,243,847 B2 1/2016 Benz
9,255,739 B2 2/2016 Aaron
9,279,619 B2 3/2016 Aaron
9,587,885 B2 3/2017 Aaron
9,995,533 B2 6/2018 Aaron
10,132,577 B2 11/2018 Martell
10,222,146 B2 3/2019 Mockry
10,288,351 B2 5/2019 Aaron
10,365,001 B2 7/2019 Salsbury
10,401,843 B2 9/2019 House
10,415,902 B2 9/2019 Shin
10,619,953 B2 4/2020 Blay
10,627,176 B2 4/2020 Shin
10,677,543 B2 6/2020 Auth
11,029,093 B2 6/2021 Shin
11,092,394 B2 8/2021 Blay
2003/0070547 A1 4/2003 Hubbard
2003/0071373 A1 4/2003 Hubbard
2004/0080060 A1 4/2004 Mockry
2004/0196631 A1 10/2004 Ueda
2004/0231824 A1 11/2004 Paolillo
2005/0012230 A1 1/2005 Kammerzell
2005/0077637 A1 4/2005 Mockry
2007/0101746 A1 5/2007 Schlom
2007/0187851 A1 8/2007 Facius
2008/0018001 A1 1/2008 Kammerzell
2008/0041087 A1* 2/2008 Muller ..... F28F 1/325 62/305
2008/0115921 A1 5/2008 Hall
2010/0010681 A1 1/2010 Zugibe
2010/0154448 A1 6/2010 Hay
2010/0281896 A1 11/2010 Al Watban
2010/0315770 A1 12/2010 Tipley
2010/0326091 A1* 12/2010 Enayati ..... F24F 5/0042 62/3.3
2011/0100593 A1 5/2011 Benz
2011/0113798 A1 5/2011 Pichai
2011/0168354 A1 7/2011 Dejong
2011/0227236 A1 9/2011 Vouche
2011/0289951 A1 12/2011 Furlong
2012/0067546 A1 3/2012 Bugler, III
2013/0113127 A1 5/2013 Yang
2013/0228941 A1 9/2013 Bogh
2014/0209279 A1 7/2014 Aaron
2014/0216688 A1 8/2014 Shelnutt
2014/0229146 A1 8/2014 Gonzalez
2015/0068708 A1 3/2015 Mockry
2015/0069643 A1 3/2015 Mockry
2016/0018125 A1 1/2016 Hamstra
2016/0178262 A1 6/2016 Rocha
2016/0313751 A1 10/2016 Risbeck
2016/0363388 A1 12/2016 Egolf
2017/0003078 A1 1/2017 Vadder
2017/0284742 A1 10/2017 Aaron
2018/0100700 A1 4/2018 Beaver
2018/0100701 A1 4/2018 Beaver
2018/0100703 A1 4/2018 Beaver
2018/0202710 A1 7/2018 Miller
2018/0224174 A1 8/2018 Hollander
2019/0145721 A1 5/2019 Blay
2019/0195524 A1 6/2019 Carter
2019/0212075 A1 7/2019 Shin
2021/0180891 A1 6/2021 Rousselet

FOREIGN PATENT DOCUMENTS

EP 0172403 B1 3/1988
EP 0264316 A1 4/1988
EP 0365815 B2 8/1999
EP 1698847 9/2006
JP 2007285620 A 11/2007
KR 101663258 B1 10/2016
WO 2005005905 1/2005
WO 2007015281 2/2007
WO 2010020160 2/2010
WO 2010037164 4/2010
WO 2012114134 A1 8/2012
WO 2015059038 4/2015
WO 2018004464 1/2018

OTHER PUBLICATIONS

Baltimore Aircoil Company; product overview of HXC: Principle of Operation from https://www.baltimoreaircoil.eu/en/products/HXC-principle-of-operation; publicly available before Mar. 19, 2019; 1 page.
Baltimore Aircoil International nv; Product Report: BAC's Expertise from plume prediction to solution brochure; publicly available before Mar. 19, 2019; 2 pages.
Lindahl, Jr., Paul; Jameson, Randall W.; Plume Abatement and Water Conversation with the Wet/Dry Cooling Tower; Presented at the 1993 Cooling Tower Institute Annual Meeting, Technical Paper No. TP93-01; Feb. 1993; 33 pages.
PCT Search Report and Written Opinion from International Patent Application No. PCT/US2020/023640 dated Jun. 9, 2020; 13 pages.
3C Condenser Heat Rejection Systems—SH09 Series Microchannel, Installation, Operation & Maintenance Manual; Muller Industries; publicly available before Jan. 20, 2014; 30 pages.
Arteaga, Johnathan A.F. et al.; Prediction Method for the Performance of a Chiller Following a Cooling Load Profile; CONEM 2010 VI National Congress of Mechanical Engineering, Aug. 18-21, 2010 Campina Grande, Paraiba, Brazil; 10 pages.

(56) References Cited

OTHER PUBLICATIONS

Bonneville Power Administration; Electric Ideas Clearinghouse—Bulletin Board—Technology Update: Optimizing Cooling Tower Performance; Nov. 1991; 4 pages.
Carrier Corporation; Carrier® Chiller System Profiles—A Guide for Chilled Water Plant Operation; brochure; Copyright 1998; 4 pages.
Chilled Water System Analysis Tool (CWSAT), Version 2.1—User's Manual; Oct. 2005; The University of Massachusetts College of Engineering Department of Mechanical & Industrial Engineering, Amherst, MA; 34 pages.
Conserve it Pty Ltd; PlantPRO® brochure from https://www.conserveitiot.com/plantpro; publicly available before Dec. 11, 2019; 13 pages.
CoolTools™ Chilled Water Plant Design Guide; Energy Design Resources; Dec. 2009; 281 pages.
DeepMind AI Reduces Google Data Centre Cooling Bill by 40%; Blog Post from https://deepmind.com/blog/article/deepmind-ai-reduces-google-data-centre-cooling-bill-40; Jul. 20, 2016; 6 pages.
Dempster, Ian; Machine Learning and Chiller System Optimization; brochure from https://www.districtenergy.org/HigherLogic/System/DownloadDocumentFile.ashx?DocumentFileKey=455e8aa2-5764-d402-ecda-89078853ddc7; Feb. 2015; 13 pages.
Deru, Michael et al.; U.S. Department of Energy Commercial Reference Building Models of the National Building Stock; Technical Report NREL/TP-5500-46861; National Renewable Energy Laboratory; Feb. 2011; 118 pages.
Energy Center of Wisconsin; Fact Sheet: Evaporative Condenser Control—Techniques to Cut Energy Waste in Large Refrigeration Systems; Copyright 2001; 2 pages.
Fan, Guo-Feng et al.; Application of the Weighted K-Nearest Neighbor Algorithm for Short-Term Load Forecasting; Energies 2019, 12, 916; doi:10.3390/en12050916; 19 pages; published Mar. 9, 2019.
Furlong, James W. et al; Optimization of Water—Cooled Chiller—Cooling Tower Combinations; CTI Journal, vol. 26, No. 1; p. 12-19; 2005; 8 pages.
García Cutillas, Clemente et al.; Optimum Design and Operation of an HVAC Cooling Tower for Energy and Water Conservation; Energies 2017, 10, 299; doi:10.3390/en10030299; 27 pages; published Mar. 3, 2017.
Geister, W. Ryan et al.; A Closer Look at Chiller Ratings; ASHRAE Journal; Dec. 2009, p. 22-32; 8 pages.
GNV GL; Impact Evaluation of 2012 National Grid-Rhode Island Prescriptive Chiller Program; report prepared by KEMA, Inc.; Jul. 22, 2016; 35 pages.
Goel, S. et al.; Enhancements to ASHRAE Standard 90.1 Prototype Building Models; Prepared for the U.S. Department of Energy under Contract DE-AC05-76RL01830 by Pacific Northwest National Laboratory, Richland WA 99352; Apr. 2014; 59 pages.
Green Koncepts Pte Ltd; Chiller Plant Optimisation—Ultra Low Energy Management with IoT & Machine Learning Controls; brochure from http://greenbuildingreview.com/wp-content/uploads/2017/10/Track-1.3-Smart-Building-Roy-Arindam.pdf; publicly available before Dec. 11, 2019; 12 pages.
Hattori, Yuki et al.; The Relationship Between Heat Load Profile and Energy Efficiency in District heating and Cooling Plant; Proceedings of Building Simulation 2011: 12th Conference of International Building Performance Simulation Association, Sydney, 14-16 November; p. 1926-1933; 8 pages.
Ho, Simon; Trane® High Performance Chilled Water Systems; presentation; EarthWise HVAC Chiller—Tower Systems; Ingersoll Rand, Inc.; Sep. 2012; 18 pages.
Hydeman, Mark et al.; PG&E's CoolTools™ Project: A Toolkit to Improve Evaluation and Operation of Chilled Water Plants; Pacific Gas and Electric Company; Sep. 1997; 24 pages.
Hydronic and Heat Pump Control features from https://www.75f.io/solutions/equipment-type/hydronic-heat-pump-control; publicly available before Dec. 11, 2019; 8 pages.
Ingersoll Rand, Inc.; Trane® New myPLVTool Provides Quick, Simple Option for Chiller Economic Comparisons; brochure; Feb. 26, 2014; 4 pages.
Jekel, Todd B. et al.; Energy Efficiency Improvements; Industrial Refrigeration Consortium at the University of Wisconsin Madison, WI; Reta National Conference 2017; 78 pages.
Jekel, Todd; Condenser Controls & Control Strategies; presentation at IRC Research & Technology Forum, Madison, WI; May 10-11, 2017; 35 pages.
Johnson Controls; Applying Artifical Intelligence to Built Environments through Machine Learning; brochure from https://www.johnsoncontrols.com/-/media/jci/insights/2019/bts/bts_jci-661_dv_ai_learning_white_paper_020819_4p_f3.pdf; publicly available before Dec. 11, 2019; 4 pages.
Johnson Controls; HVAC&R Engineering Update: Use Only NPLV to Specify Chiller Efficieny; brochure from www.johnsoncontrols.com; Copyright 2009; 4 pages.
Jourdan, Greg; Knowing When Your Chiller Isn't Energy Smart; presentation Energy/Facilities Connections Washington State University; May 6, 2015; 132 pages.
Kim, Jee-Heon et al.; Modeling and Optimizing a Chiller System Using a Machine Learing Algorithm; Energies 2019, 12, 2860; doi:10.3390/en12152860; 13 pages; published Jul. 25, 2019.
Klawunder, Shawn Eric; Thesis: Modeling and Analysis of Chilled Water Systems; Requirement for the Degree Master of Science in Mechanical Engineering at Georgia Institute of Technology, Apr. 2000; 158 pages.
Lee, W.L. et al.; Developing a Simplified Model for Evaluating Chiller-System Configurations; Applied Energy 84 (2007) 290-306; 17 pages.
Lei, Zhao et al.; Dynamic Simulation and Analysis of a Water Chiller Refrigeration System; Applied Thermal Engineering 25 (2005) 2258-2271; 14 pages.
Li, Xiao et al.; Self-Optimizing Control of Cooling Tower for Efficient Operation of Chilled Water Systems; Purdue University School of Mechanical Engineering, International High Performance Buildings Conference 2012; Paper 62; http://docs.lib.purdue.edu/ihpbc/62; 11 pages.
Navitas Captial; Whitepaper: Artificial Intelligence (AI) for the Built World; Jun. 2019; 34 pages.
Peesel, Ron-Hendrik et al.; Optimization of Cooling Utility System with Continuous Self-Learning Performance Models; Energies 2019, 12, 1926; doi:10.3390/en12101926; 17 pages; published May 20, 2019.
Pugh, Michael D.; Benefits of Water-Cooled Systems vs Air-Cooled Systems for Air-Conditioning Applications; presentation from Cooling Technology Institute (www.cti.org); publicly available before Dec. 11, 2019; 102 pages.
Schwedler, Mick et al.; Tower Water Temperature . . . Control It How??!; Engineers Newsletter, vol. 24, No. 1, 1995; The Trane Company; 5 pages.
Schwedler, Mick; Condenser Water System Savings—Optimizing Flow Rates and Control; Engineers Newsletter, vol. 41, No. 3; Trane® a business of Ingersoll Rand; Sep. 2012; 8 pages.
SPX Cooling Technologies, Inc.; Marley® Improving Energy Efficiency in Cooling Tower Design; presentation; publicly available before Dec. 11, 2019; 24 pages.
Stocki, Michael et al.; Benchmarking an Energy Evaluation Tool for Chilled Water Systems; published by The American Counsil for an Energy-Efficient Economy (ACEEE); 2001; pp. 429-440; 12 pages.
Sullivan, Brian; Chiller Selection Made Easier with myPLV™; Engineers Newsletter, vol. 44, No. 4; Trane® a business of Ingersoll Rand; Dec. 2015; 12 pages.
Taylor, Steven T.; Optimizing Design & Control of Chilled Water Plants—Part 5: Optimized Control Sequences; ASHRAE Journal; Jun. 2012; pp. 56-74; 20 pages.
Tiessen, Alex et al.; Chapter 14: Chiller Evaluation Protocol—The Uniform Methods Project: Methods for Determining Energy Efficiency Savings for Specific Measures; Subcontract Report NREL/SR-7A40-62431; National Renewable Energy Laboratory; Sep. 2014; 24 pages.
TrilliumSeries™ Condenser—Rigging, Operation & Maintenance Manual; Baltimore Aircoil Company; M450/I-E; 2013; 20 pages.

(56) References Cited

OTHER PUBLICATIONS

TrilliumSeries™ Condenser; brochure from Baltimore Aircoil Company; S410/I-C; 2013; 12 pages.
U.S. Department of Energy—Hospital Energy Alliance; Fact Sheet: Hospitals Benefit by Improving Inefficient Chiller Systems; Aug. 2011; 2 pages.
Vallabhaneni, Kavita A.; Benefits of Water-Cooled Systems vs. Air-Cooled Systems for Air-Conditioning Applications; presentation from Cooling Technology Institute (www.cti.org); publicly available before Dec. 11, 2019; 88 pages.

* cited by examiner

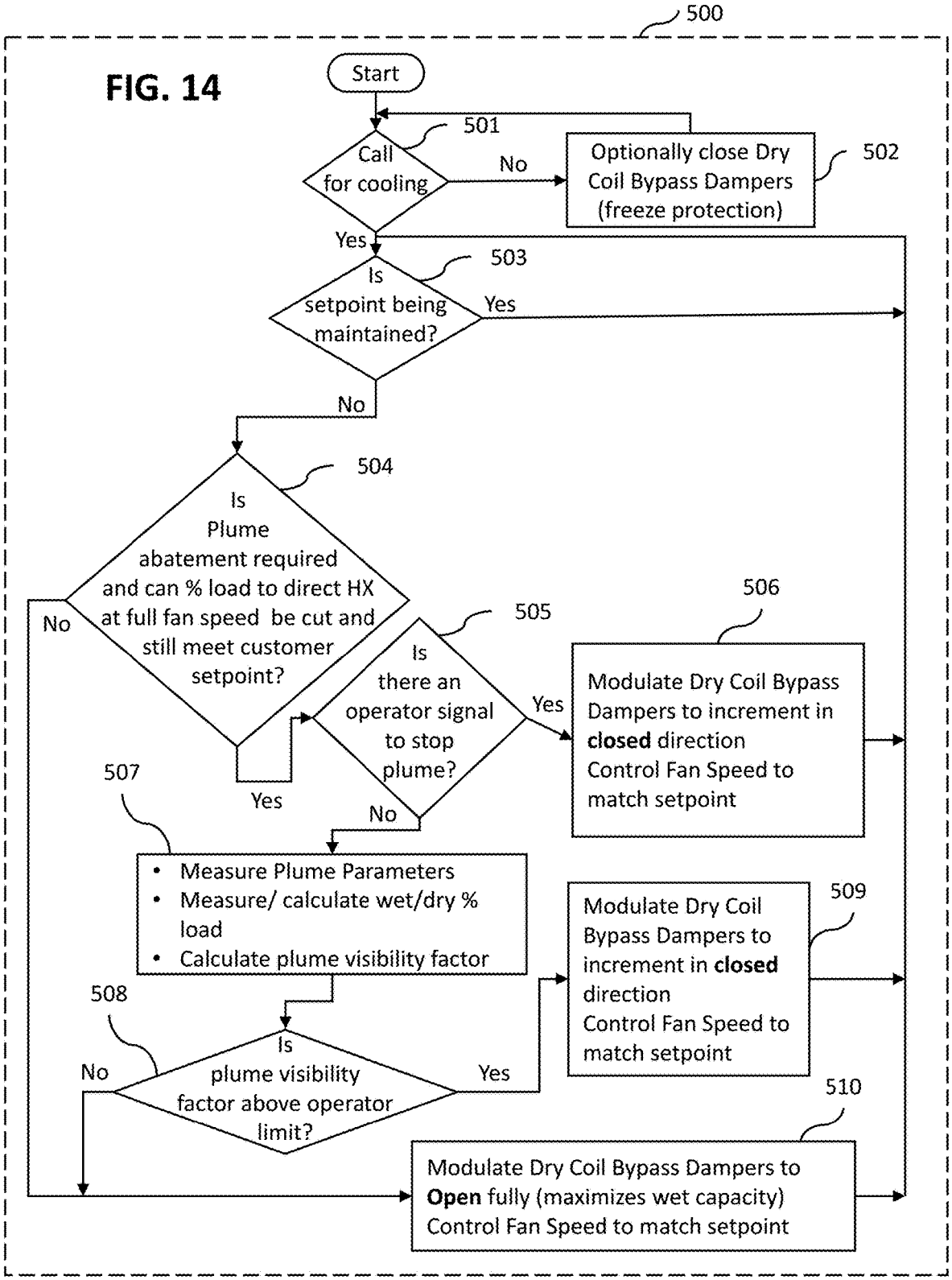
500
FIG. 14
Start
501
Call for cooling
No
Optionally close Dry Coil Bypass Dampers (freeze protection)
502
Yes
503
Is setpoint being maintained?
Yes
No
504
Is Plume abatement required and can % load to direct HX at full fan speed be cut and still meet customer setpoint?
No
505
Is there an operator signal to stop plume?
Yes
506
Modulate Dry Coil Bypass Dampers to increment in closed direction Control Fan Speed to match setpoint
Yes
No
507
• Measure Plume Parameters
• Measure/ calculate wet/dry % load
• Calculate plume visibility factor
508
Is plume visibility factor above operator limit?
No
Yes
509
Modulate Dry Coil Bypass Dampers to increment in closed direction Control Fan Speed to match setpoint
510
Modulate Dry Coil Bypass Dampers to Open fully (maximizes wet capacity) Control Fan Speed to match setpoint

HEAT EXCHANGER HAVING PLUME ABATEMENT ASSEMBLY BYPASS

CROSS-REFERENCE TO RELATED APPLICATION

This application claims benefit of U.S. Provisional Application No. 62/820,546 filed Mar. 19, 2019, which is hereby incorporated herein by reference in its entirety.

FIELD

This disclosure relates to evaporative heat exchangers and, more specifically, relates to hybrid evaporative heat exchangers that operate with wet indirect heat exchangers and dry indirect heat exchangers.

BACKGROUND

Some hybrid evaporative heat exchangers operate by transmitting fluid that needs to be indirectly cooled first through a dry, indirect heat exchanger and then through a wet, indirect heat exchanger. As used herein, the term dry indirect heat exchanger refers to a heat exchanger that does not utilize evaporative cooling to cool the fluid. On the other hand, the term wet indirect heat exchanger refers to a heat exchanger that utilizes evaporative cooling to cool the fluid.

Wet indirect heat exchangers use a "wet" process that dispense evaporative liquid, such as water, over the evaporative indirect heat exchanger coils which invokes the principals of evaporation to further increase the rate of heat transfer from the fluid. For instance, an evaporative indirect heat exchange process can operate about five times more efficiently than a dry heat exchange process. In some prior hybrid evaporative heat exchangers that operate with at least one wet and one dry indirect heat exchanger, the discharge air from the wet heat exchanger section goes directly to the ambient air and has no plume abatement feature, such as disclosed in U.S. Pat. No. 9,243,847 to Benz. Other hybrid evaporative heat exchangers, such as disclosed in U.S. Pat. No. 6,142,219 to Korenic, have hot, nearly saturated, discharge air pass entirely through dry heat exchange coils. Dry indirect heat exchangers typically have a fin and tube arrangement to increase the surface area of the heat exchanger. Further, dry indirect heat exchangers typically increase the static pressure drop seen by air passing through the hybrid evaporative heat exchanger.

BRIEF DESCRIPTION OF THE DRAWINGS

FIG. 14 shows control logic that may be used with the heat exchangers of FIGS. 7 and 8.

DETAILED DESCRIPTION

Figure 1:
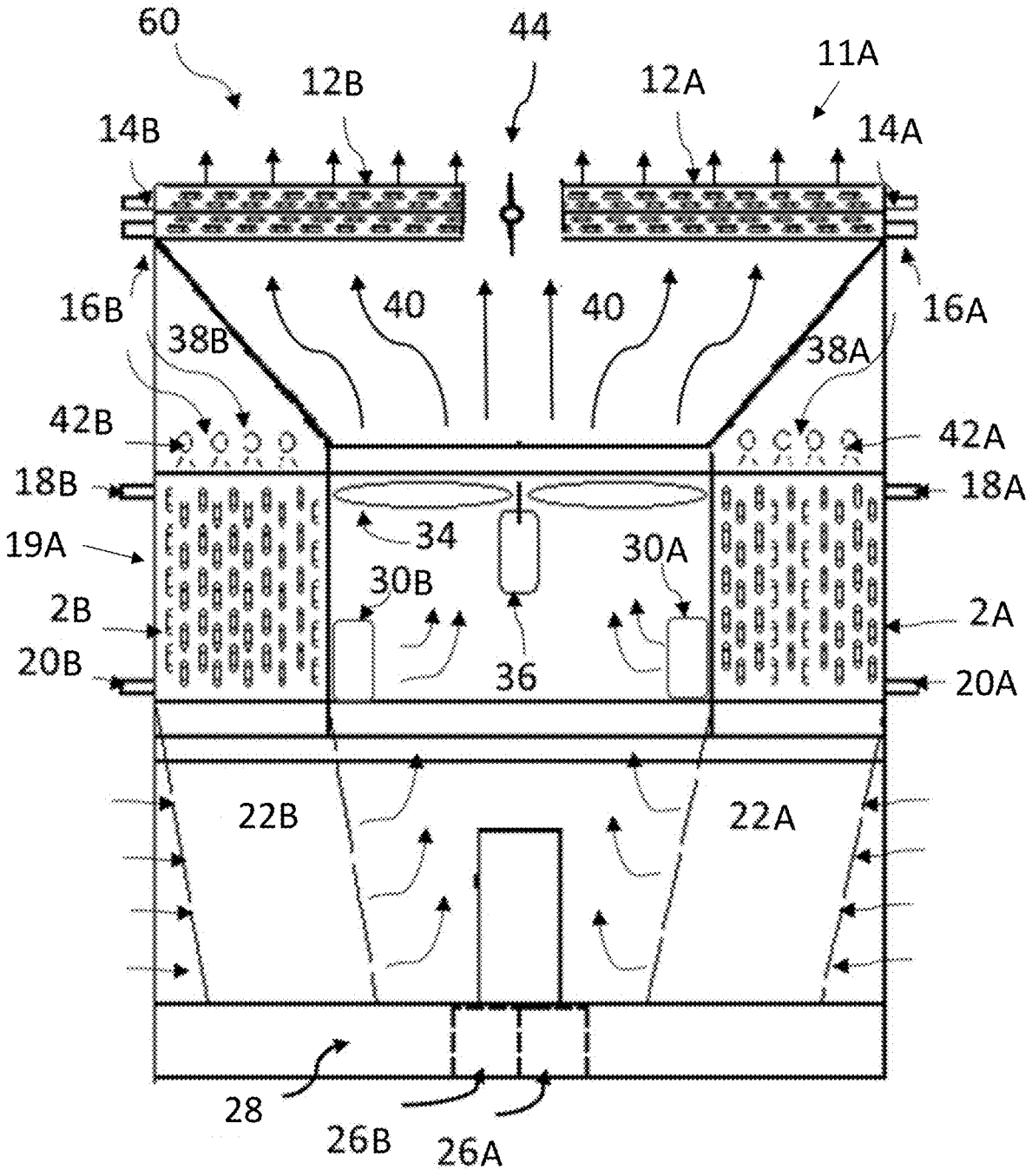
FIG. 1 shows an embodiment of a hybrid evaporative heat exchanger having at least one wet indirect heat exchanger, at least one dry indirect heat exchanger, and a dry indirect heat exchanger bypass damper.

In one aspect of the present disclosure, a heat exchange apparatus is provided that includes an evaporative heat exchanger assembly and a plume abatement assembly downstream of the evaporative heat exchanger assembly. The evaporative heat exchanger assembly may include, for example, serpentine coils and/or fill and an evaporative liquid distribution system. The plume abatement assembly includes as at least one heating element configured to increase the temperature of the airflow. As an example, the at least one heating element may include a dry heat exchanger configured to receive process fluid or another heat source such as steam or waste heat. The plume abatement assembly may also include a bypass such as an opening modulated in size by one or more closure members such as a damper or louvers.

The plume abatement assembly has an operative configuration wherein the airflow travels through the at least one heating element to permit the at least one heating element to raise the temperature of the airflow. The plume abatement assembly has a bypass configuration wherein less of the airflow travels through the at least one heating element of the plume abatement assembly. In one embodiment, the plume abatement assembly has an opening that is fully closed with the plume abatement assembly in the operative configuration and open with the plume abatement assembly in the bypass configuration. In other embodiments, the plume abatement assembly has an opening that is partially open with the plume abatement assembly in the operative configuration and more open with the plume abatement assembly in the bypass configuration. A closure member such as a damper may be used to modulate the size of an opening of the plume abatement assembly. As another example, dry heat exchangers of the plume abatement assembly may be moved relative to one another to modulate the size of an opening of the plume abatement assembly. In some embodiments, the number of openings may be adjusted to modulate the size of the opening. For example, the plume abatement assembly may have one opening that is open with the plume abatement assembly in the operative configuration and five openings that are open with the plume abatement assembly in the bypass configuration. The number and size of the openings of the plume abatement assembly may be configured for a particular application.

In one embodiment, the plume abatement assembly includes a dry heat exchanger assembly. The heat exchange apparatus may include a housing configured so that substantially all of the air that leaves the evaporative heat exchanger assembly travels through the dry heat exchanger assembly before leaving the hybrid evaporative heat exchanger.

In another aspect of the present disclosure, a hybrid evaporative heat exchanger is provided that may include a control system that operates a bypass damper to, for example, maximize the efficiency of the heat exchange system while reducing or eliminating plume when required. The control logic system may prioritize plume abatement and may save energy or water as a second consideration. If there is no need for plume abatement, or during times when the evaporative discharge air will not create a plume, then the control system may prioritize saving water and energy depending on the customer preference. In addition to abating plume from the wet indirect heat exchange section, the hybrid evaporative heat exchanger may operate in a dry mode wherein only the dry indirect heat exchanger is utilized which reduces water consumption. The hybrid evaporative heat exchanger may have a control system with a dry mode wherein the control system operates the dry indirect heat exchanger and limits operation of the wet indirect heat exchanger; a wet mode wherein the control system operates the wet indirect heat exchanger; and a hybrid mode wherein the control system operates both the wet and dry indirect heat exchangers for example operating the dry indirect heat exchanger to abate plume. The hybrid evaporative heat exchangers disclosed herein may also include direct heat exchangers, such as fill packs, to cool water that is sprayed onto the wet indirect heat exchanger.

This application provides examples of hybrid evaporative heat exchangers including incorporating at least one wet evaporative indirect heat exchange section and at least one dry indirect heat exchange section. The dry indirect heat exchange section may be used to abate plume from the wet section, be used to enhance the capacity of the dry performance of the unit, save water, conserve energy, or a combination thereof. The hybrid evaporative heat exchangers may include one or more dry heat exchange coil bypass dampers and an automated control system to maximize the efficiency of the heat exchange system while reducing or eliminating plume when required. The control system may prioritize plume abatement and may save energy or water as a second consideration. If there is no need for plume abatement, or during times when the discharge air will not create a plume, then the control system can prioritize saving water and energy depending on the customer preference.

A control system is disclosed that may have control logic used to operate the hybrid evaporative heat exchanger to indirectly cool or condense process fluid while reducing or eliminating visible plume while also saving energy and saving water depending on the customer's requirements. The control logic operates one or more dry heat exchanger bypass dampers of the hybrid evaporative heat exchanger so that the dry heat exchanger bypass dampers remain fully closed in the dry operation mode or when plume cannot be tolerated, partially closed to abate plume and balance the load between the wet indirect and dry indirect heat exchange sections when required, and open or partially open during the wet evaporative mode. This control logic may increase the airflow through the wet evaporative heat exchanger during wet operation thereby increasing the capacity of the heat exchange system during the wet operation, while having the ability to reduce or eliminate visible plume. The control logic may also save water by closing or partially closing the dry heat exchanger bypass dampers which promotes more heat transfer in the dry coil and the control logic may also turn off a spray pump to essentially cut the water evaporation in half. The control logic may also save energy by opening or partially opening the dry heat exchanger bypass dampers when desired to cause more of the heat load to be cooled in the evaporative indirect heat exchange sections. The control logic prioritizes plume abatement and may save water or energy as secondary considerations per the customer requirements. During the peak time of day, when energy costs escalate, the customer requirements may change from saving water to saving energy and these variables are fed into the control logic to make the proper decisions per the customer's request. In an embodiment with a direct evaporative heat exchange section and a dry plume abatement coil, the dry coil bypass damper opens to allow full wet operation and can be closed to abate plume.

Figure 2A:
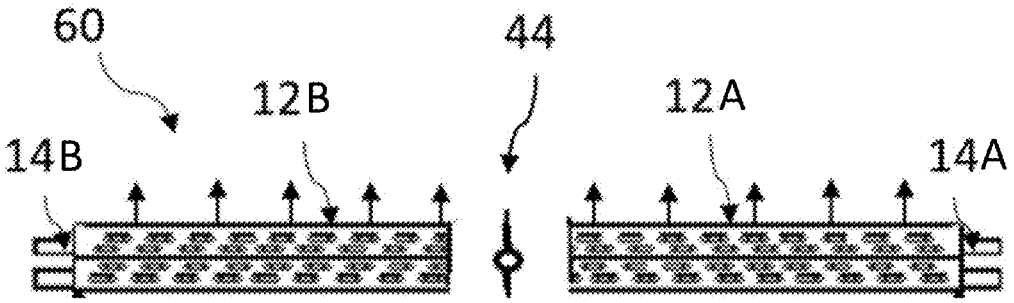
FIG. 2A shows the dry indirect heat exchanger bypass damper of FIG. 1 in a fully open position.
Figure 2B:
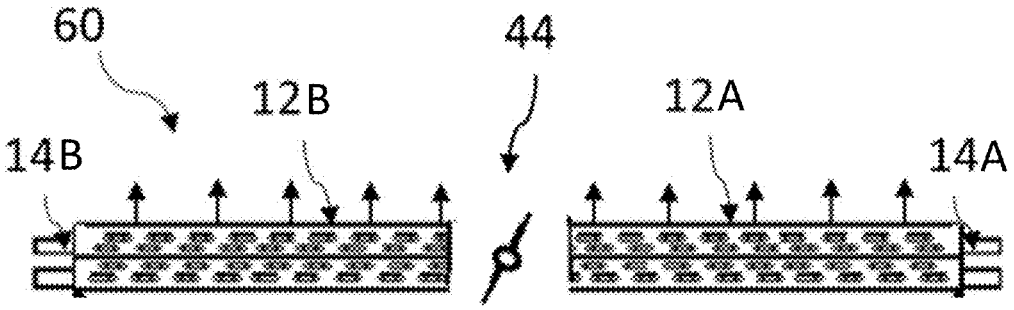
FIG. 2B shows the dry indirect heat exchanger bypass damper of FIG. 1 in a modulated partially open position.

Regarding FIG. 1, a hybrid evaporative heat exchanger is provided such as hybrid heat exchanger 60. The hybrid heat exchanger 60 has at least one indirect heat exchanger, such as two wet indirect heat exchangers, 12A and 12B. The hybrid heat exchanger 60 includes a plume abatement assembly 11A including two dry indirect heat exchangers 12A and 12B and a dry indirect heater bypass damper 44. The dry indirect heat exchangers 12A, 12B may include at least one of a serpentine tube, plate, and tube-and-fin style heat exchangers. The plume abatement assembly 11A has an operative configuration with the damper 44 closed (see FIG. 2) and a bypass configuration with the damper 44 partially open (FIG. 2B) or fully open (FIG. 2A). Hybrid heat exchanger 60 is used to indirectly cool or condense process fluid which enters at connections 14A and 14B, is cooled in dry heat exchangers 12A and 12B, then exits connections 16A and 16B. The fluid may be piped directly back to the process or may be piped directly to indirect heat exchangers connectors 20A and 20B.

If the application is for a condenser, exit connections 16A and 16B are piped to connectors 18A and 18B. The process fluid is then indirectly cooled in wet indirect heat exchangers 2A and 2B then exits connections 20A and 20B and is then returned back to the process.

Spray pumps 26A and 26B are turned on when it is desired to pump sump water from sump 28 to sprays 42A and 42B. The spray water flows over wet indirect heat exchangers 2A and 2B and onto a direct heat exchanger for cooling the spray water, such as fill sections 22A, 22B. Spray pumps 26A and 26B can be selectively be both running to maximize energy savings, or only one pump may run to increase the dry performance and save water, or both pumps may be off for 100% dry operation. Fan 34 includes a motor 36 and is typically varied in speed to match the unit heat rejection to the customer desired process fluid setpoint. Fresh ambient air enters wet indirect heat exchangers 2A and 2B from air inlet plenum 38A and 38B. Fresh ambient air also enters direct sections 22A and 22B and discharges into the common discharge plenum under fan 34. Discharge air from fan 34 enters plenum 40 where it then flows through dry indirect heat exchangers 12A and 12B. Air also flows generally downward and across wet indirect heat exchangers 2A and 2B, through mist eliminators 30A and 30B, up through fan 34 to plenum 40, and then through dry heat exchangers 12A and 12B.

Regarding FIG. 1, the dry indirect heater bypass damper 44 bypasses a portion of wet moist air from plenum 40 around indirect dry heat exchangers 12A and 12B. The dry indirect heater bypass damper 44 may be sized to allow some discharge air from plenum 40 to exit through indirect dry heat exchangers 12A and 12B.

When open, dry indirect heat exchanger bypass damper 44 reduces the static pressure fan 34 sees which ultimately increases airflow through wet indirect heat exchangers 2A and 2B and also increases the airflow through fill 22A, 22B. Increasing the airflow through these evaporative heat exchangers increase the wet performance of the hybrid unit ultimately saving energy. In addition, the dry indirect heat exchanger bypass damper 44 may be fully opened to maximize wet performance, be fully closed to maximize dry performance, or closed to eliminate any visible plume and save water. The dry indirect heat exchanger bypass damper 44 may modulate to control plume and the heat load seen by the wet and dry indirect heat exchangers, which may balance the degree of energy savings, water savings, and plume abatement.

Figure 2C:
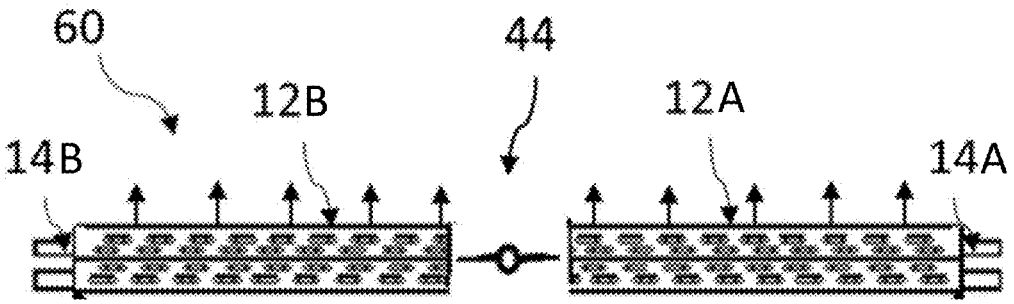
FIG. 2C shows the dry indirect heat exchanger bypass damper of FIG. 1 in a fully closed position.

Now referring to FIG. 2A, dry indirect heat exchanger bypass damper 44 is shown in the fully open position, while in FIG. 3B the dry indirect heat exchanger bypass damper 44 is shown in a modulated, partially open position. The modulated position of the damper 44 may be any position between fully open (FIG. 2A) and fully closed (FIG. 2C).

Figure 3:
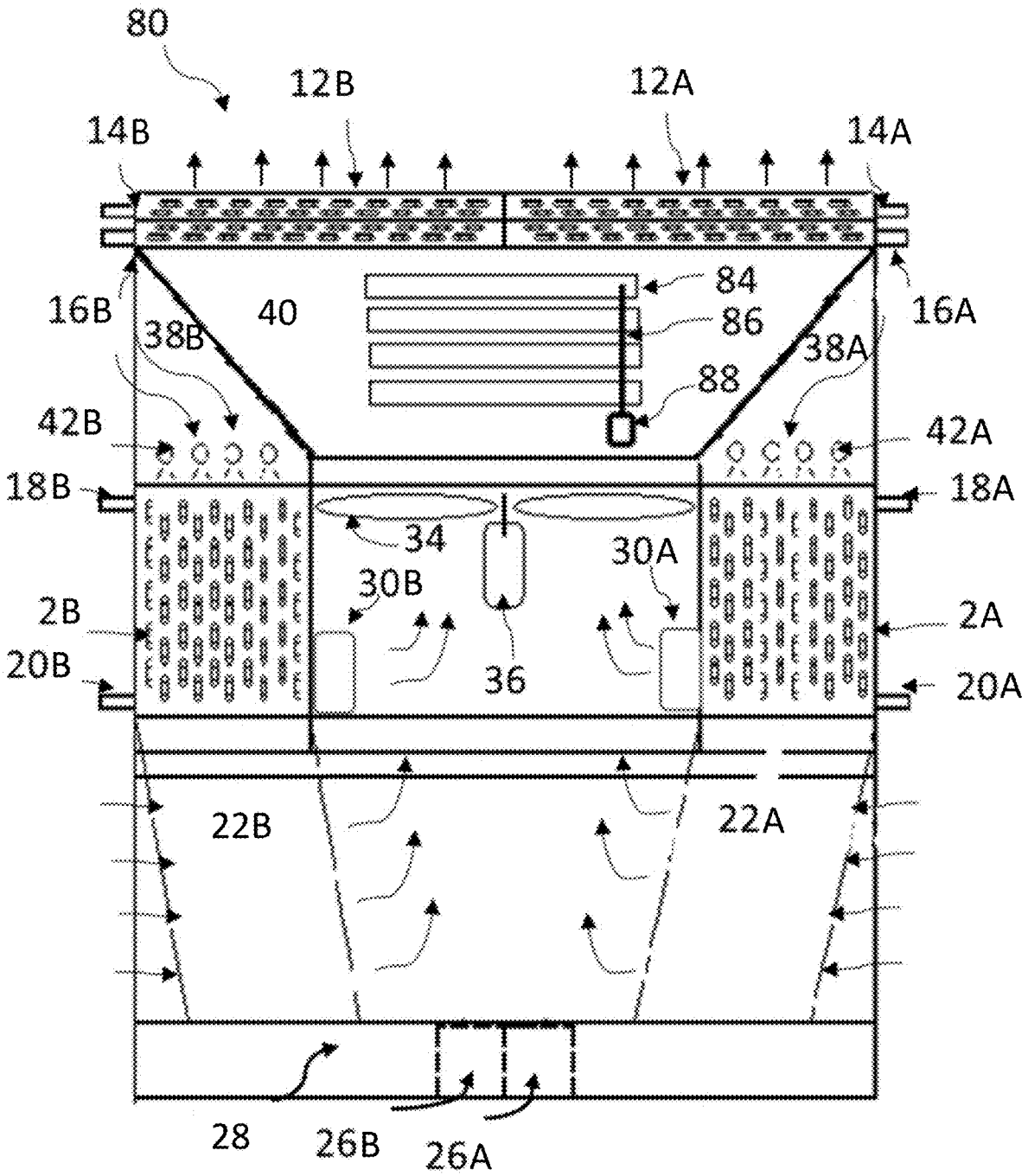
FIG. 3 shows another hybrid evaporative heat exchanger that incorporates dry heat exchanger bypass dampers installed in a side discharge plenum of the unit.

Now referring to FIG. 3, a hybrid heat exchanger 80 is provided that is similar in many respects to the hybrid heat exchanger 60 discussed above with similar reference numerals identifying similar components. The hybrid heat exchanger 80 includes a plume abatement assembly including indirect dry heat exchangers 12A, 12B and a closure member, such as dry indirect heat exchanges bypass dampers 84, that are opened and closed by connecting linkages 86 and driven open or closed by a damper motor 88. Dry heat indirect heat exchanger bypass dampers 84 are located in the side walls of plenum 40.

Figure 4:
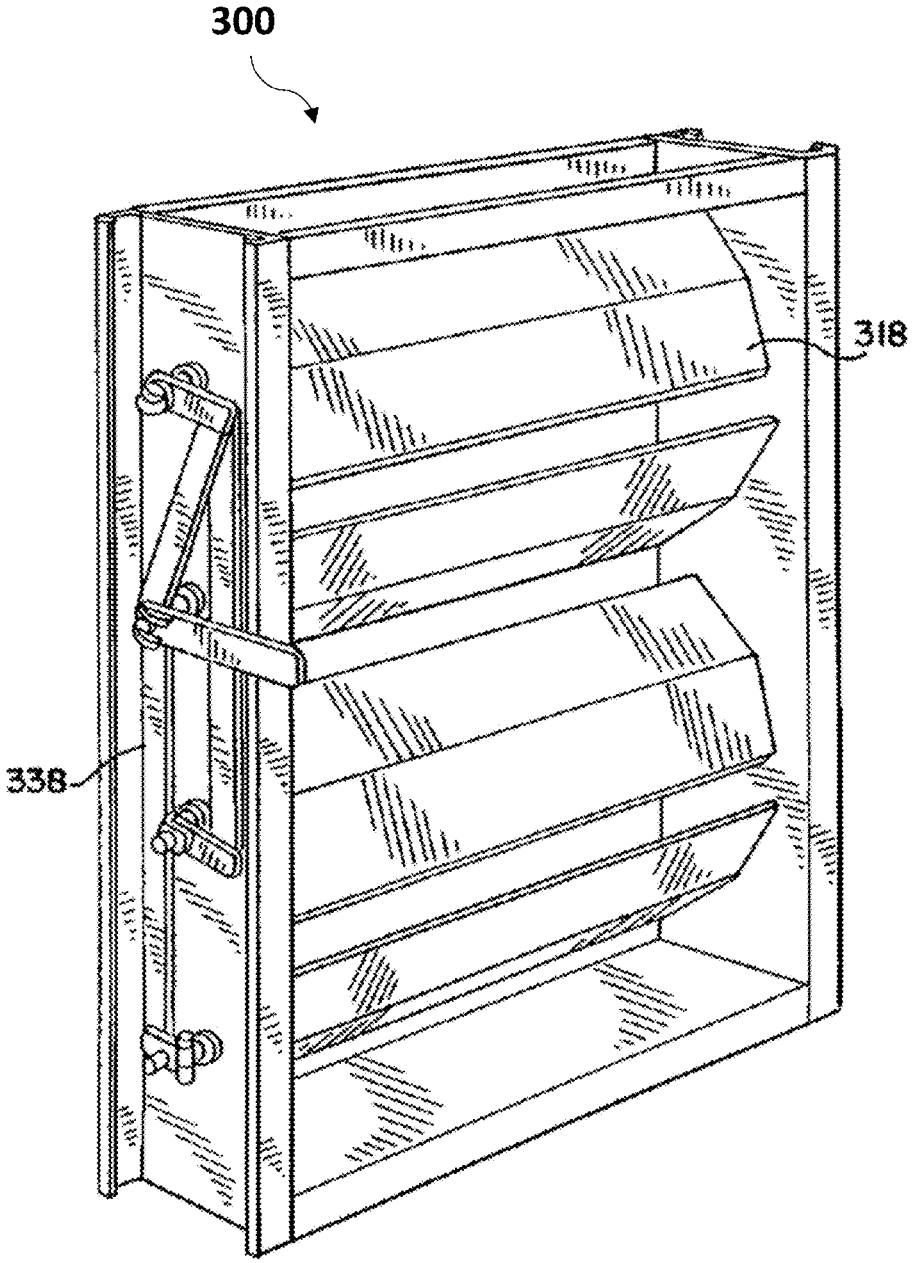
FIG. 4 shows a damper assembly of the hybrid evaporative heat exchanger of FIG. 3.

Now referring to FIG. 4, in one embodiment the dry indirect heat exchanger bypass dampers 84 may include a bypass damper assembly 300 having damper blades 318 connected to linkage assembly 338. Linkage assembly 338 is normally connected to a damper motor.

Figure 5:
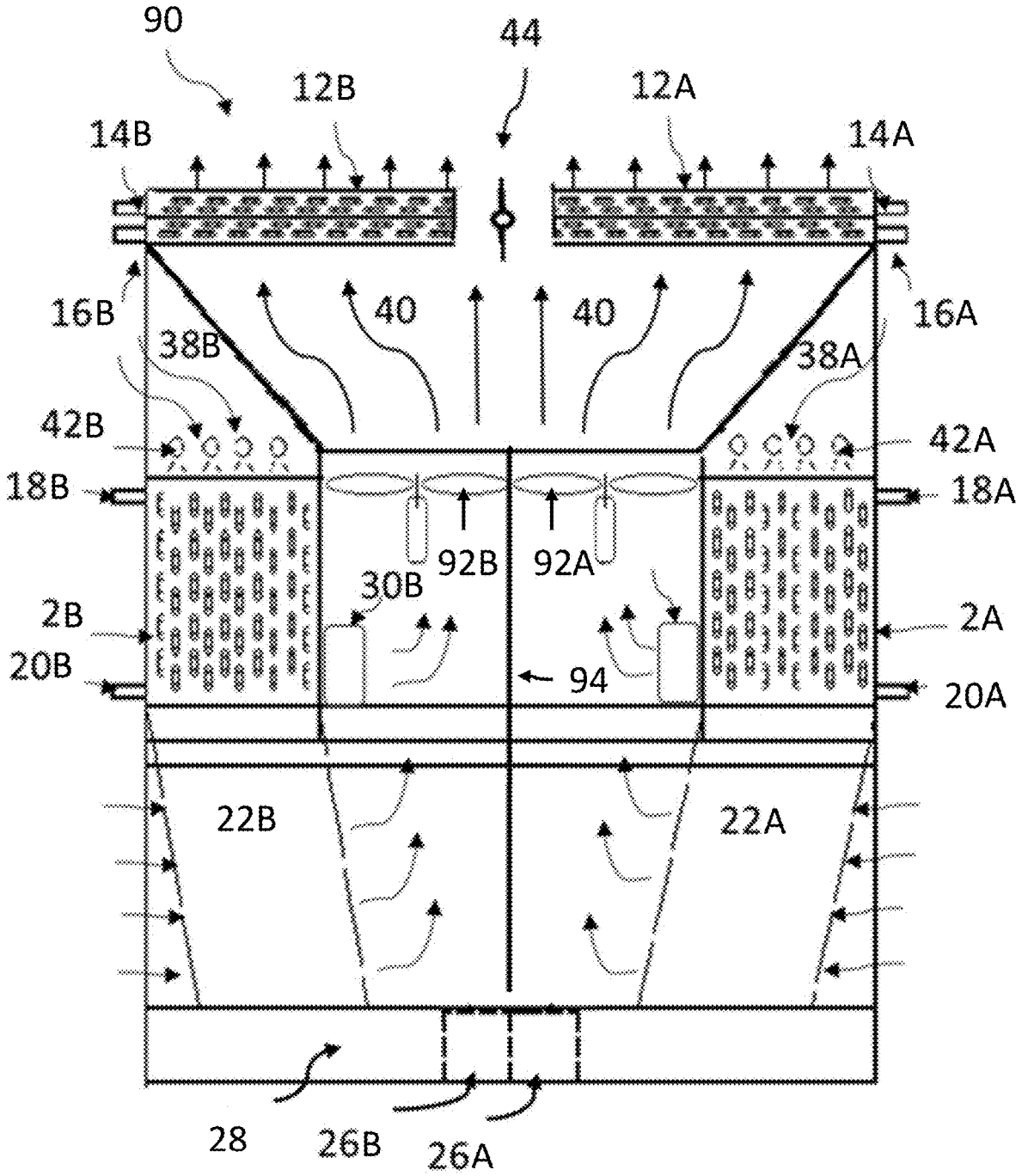
FIG. 5 shows a hybrid evaporative heat exchanger including at least one wet indirect heat exchanger, at least one dry indirect heat exchanger, and a dry indirect heat exchanger bypass damper with independent fans for each side of the hybrid evaporative heat exchanger.

Referring to FIG. 5, a hybrid heat exchanger 90 is provided that is similar in many respects to the hybrid heat exchanger 60 with similar reference numerals identifying similar components. The hybrid heat exchanger 90 includes fans 92A and 92B that allow a further step in control of wet versus dry hybrid unit capacity. For example, if spray pump 26A and fan 92A are on while spray pump 26B and fan 92B are off, the amount of water evaporation will be cut in half which reduces water consumption. Divider wall 94 allows each fan 92A and 92B to operate independently until the air is mixed in discharge plenum 40. When the wet moist discharge air from fan 92A, again with spray pump 26A on, mixes in discharge plenum 40 with dry heated air from fan 92B, again with spray pump 26B off, the mixing will reduce or eliminate plume as well.

Figure 6:
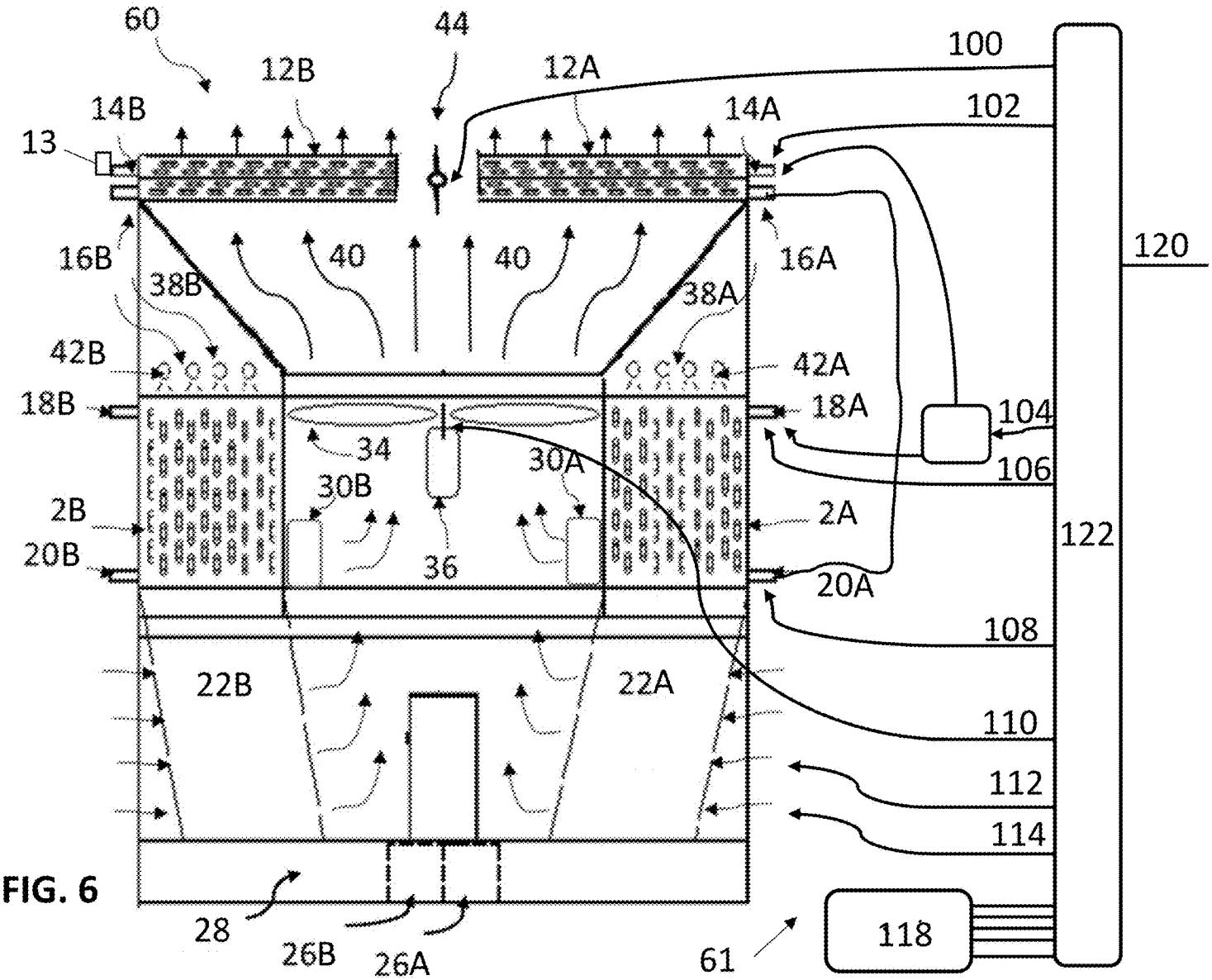
FIG. 6 is a schematic view of a hybrid evaporative heat exchanger and a control system thereof.

Regarding FIG. 6, further details are provided regarding the hybrid heat exchanger 60 of FIG. 1. The hybrid heat exchanger 60 includes a central system 61 such as a central processing unit 118 (CPU) and an input such as a processor bus 122 that receives one or more parameters relating to operation of the hybrid heat exchanger 60. The processor bus 122 may receive a signal representative of a dry indirect heat exchanger bypass damper position 100, typically from a potentiometer mounted on the damper motor, which indicates the position of the damper(s) between 0 to 100%. FIG. 6 shows one embodiment of interconnecting piping connecting the outlet of the dry coil outlet 16A to the wet evaporative coil inlet 20A. The hybrid heat exchanger 60 includes temperature sensors for measuring inlet process fluid temperature 102 along with dry heat transfer coil outlet temperature 108 and process fluid outlet temperature 106. These three temperatures are used to calculate the wet versus dry load that is being rejected by hybrid heat exchanger 60. Differential pressure sensor 104 is connected to the overall process fluid connections 14A and 18A which measures the overall pressure drop of both the wet and dry indirect heat exchangers 2A and 12A.

With a look up table, the CPU 118 converts this differential pressure measured 104 to a process fluid flow rate. Alternatively, a direct measurement of the flow rate may be measured with a magnetic flow meter and fed to CPU 118 or this flow rate may be measured by the customer and fed to the CPU 118 via the processor bus 122 through customer port 120. Customer port 120 may be used to provide the operating mode, outside ambient conditions, process fluid and many other variables passed between the customer and the control process 118. The speed of the fan motor 36 is provided to CPU 118 via VFD signal 110. Finally, dry bulb ambient temperature and % relative humidity are measured via sensors 112 and 114 respectively and provided to the CPU 118 so that the psychrometric properties of the ambient air may be readily calculated and used for the logic of plume abatement as discussed below. In another embodiment, the dry bulb ambient temperature and % relative humidity may be received through the customer port 120 such as from a remote server computer over the internet. One or more other sensors may be used, such as a temperature sensor at the outlet of dry indirect heat exchangers 12A, 12B and/or a plume detector sensor.

Figure 7:
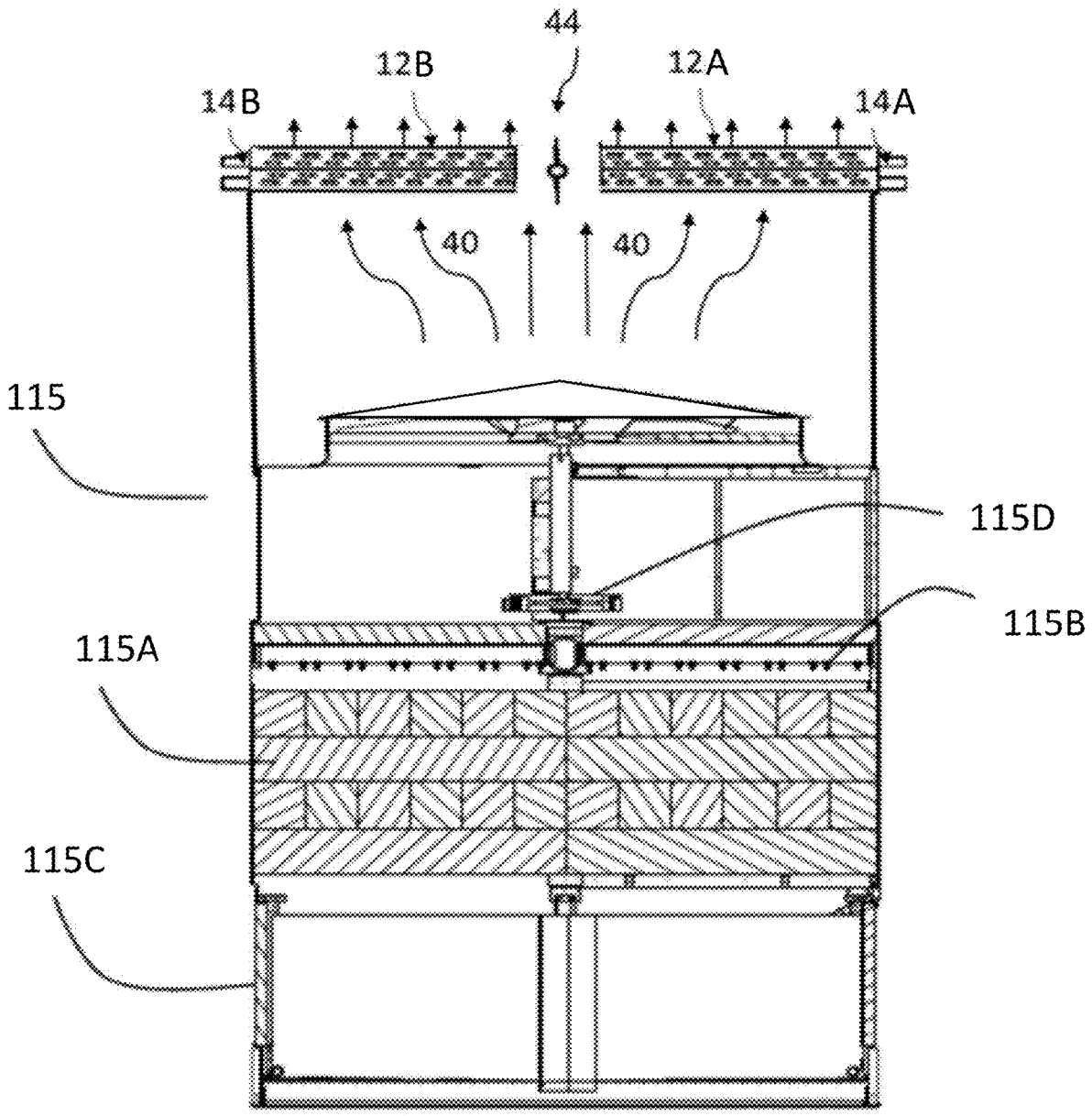
FIG. 7 shows a hybrid evaporative heat exchanger including a wet indirect heat exchanger, a dry indirect heat exchanger, and a dry indirect heat exchanger bypass damper.

Now referring to FIG. 7, embodiment 115 is a direct evaporative heat exchanger or cooling tower equipped with dry indirect heat exchangers 12A and 12B. Dry indirect heat exchangers 12A and 12B may be used to abate plume and also be used to provide a hybrid mode of dry operation. Process fluid or a fluid source other than process fluid needing to be cooled may be piped in and out of dry coils 12A and 12B through connections 14A and 14B. This may be a waste heat source or any fluid warmer than the ambient temperature. In many cases, the process fluid is piped first to the dry coils 12A and 12B and the outlet connection is then piped to the spray piping 115B where the process fluid can be evaporatively cooled though a direct heat exchanger such as counterflow fill media 115A. The control of dry coil bypass damper 44 may be used to abate plume, operate in a dry hybrid mode or be used to save water and energy. The embodiment 115 may include a fan 115D and one or more louvers 115C upstream of the fill media 115A.

Figure 8:
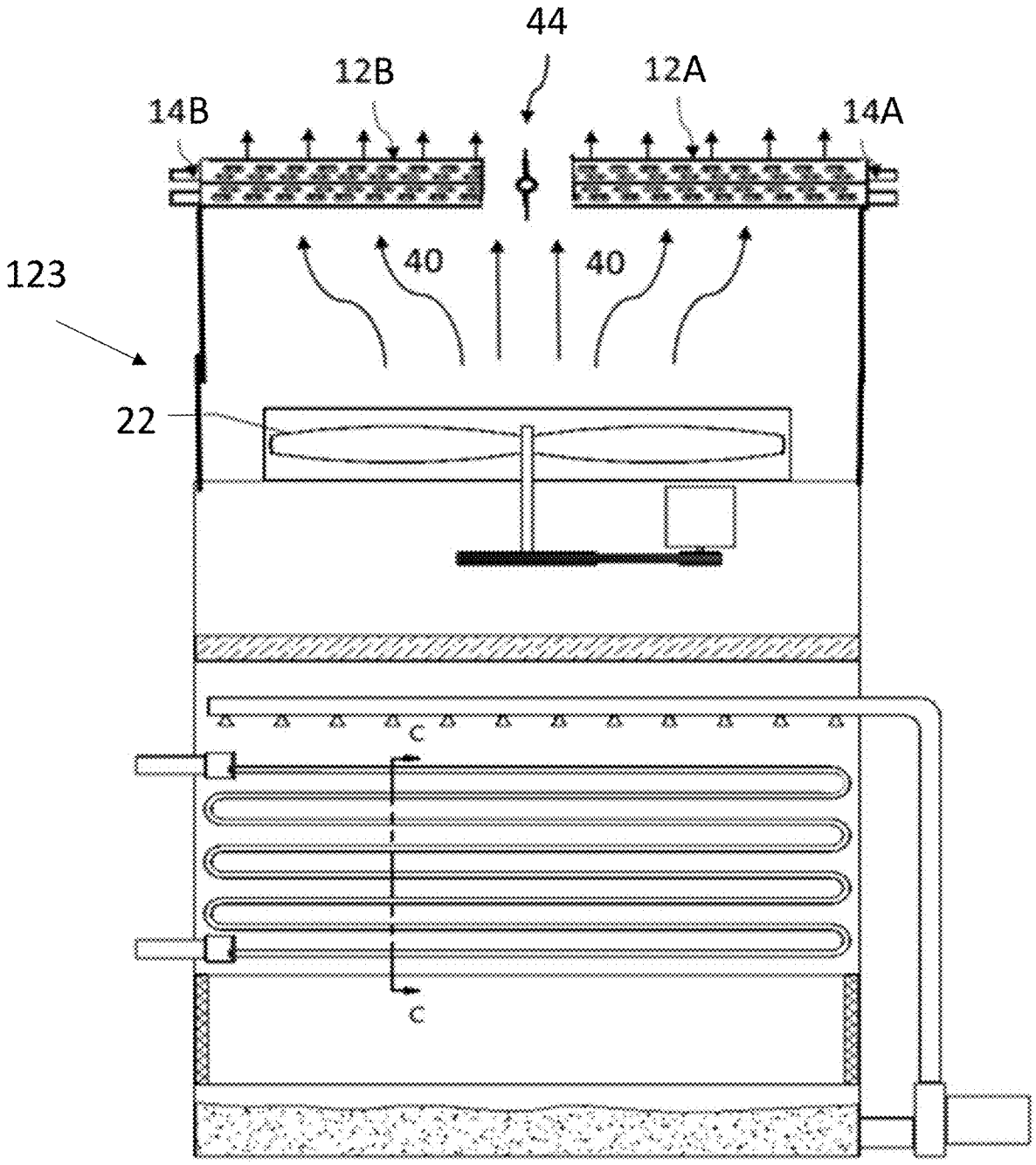
FIG. 8 shows a hybrid evaporative heat exchanger including a wet indirect heat exchanger, a dry indirect heat exchanger, and a bypass damper.

Now referring to FIG. 8, embodiment 123 is an indirect evaporative heat exchanger such as an evaporative fluid cooler or evaporative condenser. Embodiment 123 includes dry indirect heat exchanger 12A and 12B that may be used to abate plume and also be used to provide a hybrid mode of dry operation. Process fluid or a fluid source other than process fluid needing to be cooled may be piped in and out of dry coils 12A and 12B through connections 14A and 14B. This can be a waste heat source or any fluid warmer than the ambient temperature.

Alternatively, during hybrid operation, process fluid is piped first to the dry coils 12A and 12B and the outlet connection is then piped to the indirect coil connect 15 where the process fluid may be evaporatively cooled through wet indirect coil heat exchanger 14. The control of dry coil bypass damper 44 may be used to abate plume, operate in a dry hybrid mode, or be used to save water and energy.

Figure 9:
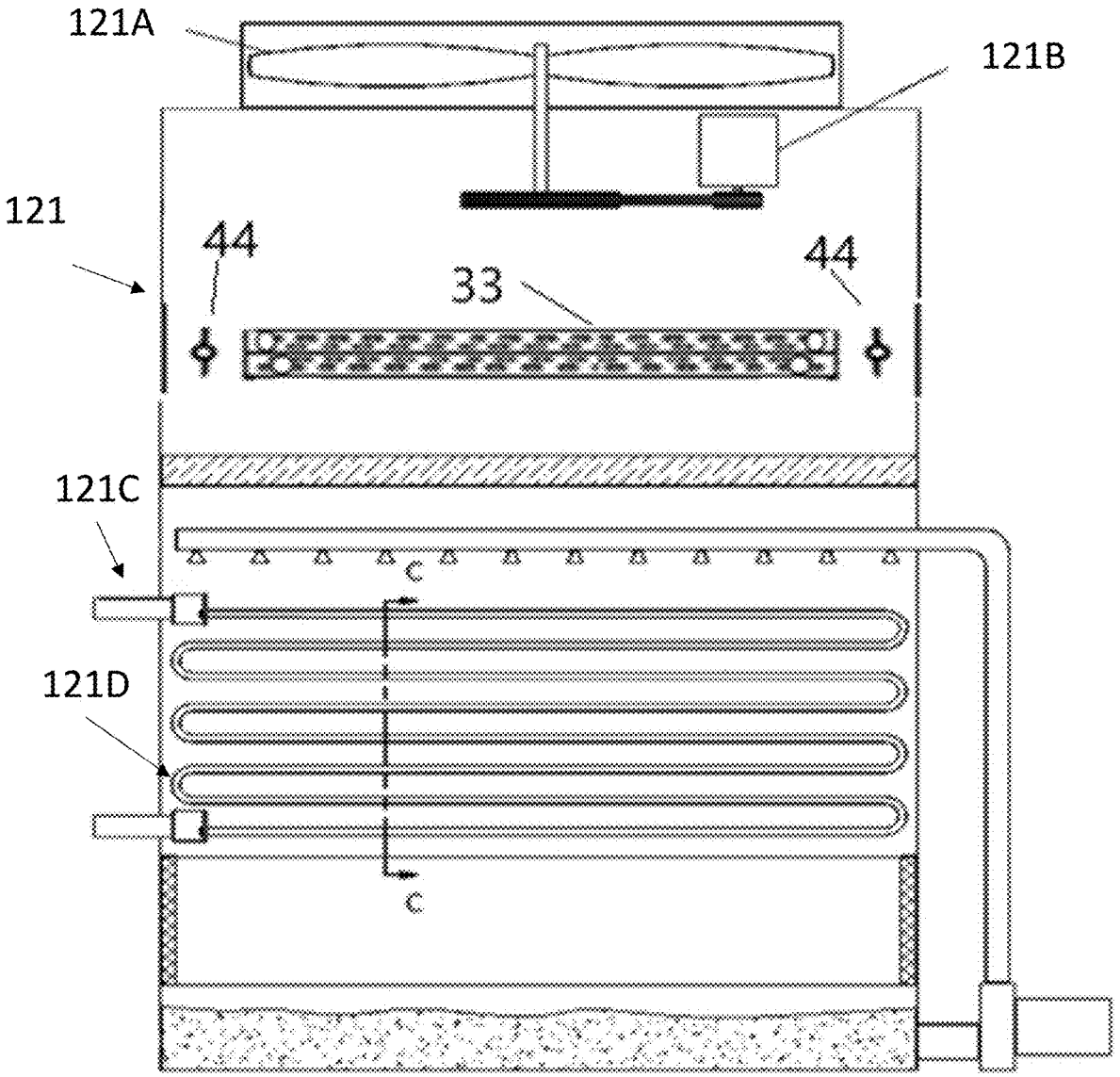
FIG. 9 shows a hybrid evaporative heat exchanger including a wet indirect heat exchanger, a dry indirect heat exchanger, and a dry indirect heat exchanger bypass damper with the dry indirect heat exchanger and the bypass damper located below the discharge fan.

Now referring to FIG. 9, embodiment 121 is an indirect evaporative heat exchanger such an evaporative fluid cooler or evaporative condenser. Embodiment 121 includes an axial fan 121A with a motor 121B within the unit and is equipped with a dry indirect heat exchanger 33. The dry indirect heat exchanger 33 may be used to abate plume and also be used to provide a hybrid mode of dry operation. A fluid source other than process fluid needing to be cooled can be piped in and out of dry indirect heat exchanger 33. The fluid source may be a waste heat source or any fluid warmer than the ambient temperature.

Alternatively, during hybrid operation, process fluid is piped first to the dry indirect heat exchanger 33 and the outlet connection is then piped to the indirect coil connection 121C where the process fluid can be evaporatively cooled through wet indirect heat exchanger 121D. The control of dry indirect heat exchanger bypass dampers 44 may be used to abate plume, operate in a dry hybrid mode, or be used to save water and energy.

Figure 10:
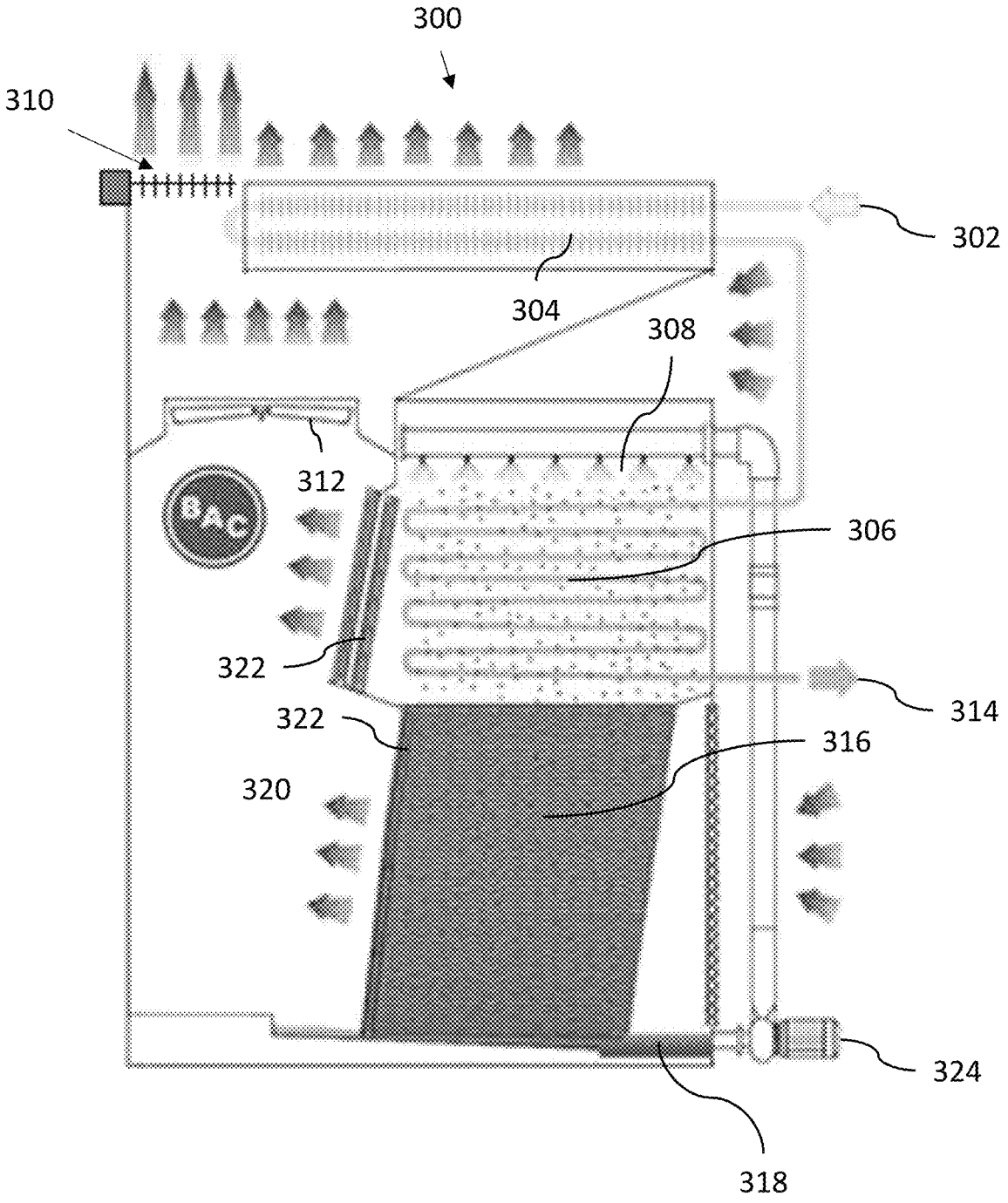
FIG. 10 shows a hybrid evaporative heat exchanger having a wet indirect heat exchanger, a dry indirect heat exchanger, and a dry indirect heat exchanger bypass damper.

Now referring to FIG. 10, embodiment 300 includes refrigerant vapor 302 or alternatively process fluid, which passes first through the dry coil 304 and then enters the prime surface coil 306, which is wetted by a spray system 308. Operation of dry coil bypass dampers 310 may be used to abate plume, save water and/or save energy (explained below). Axial fan 312 draws air over the prime surface coil 306 in parallel with the water spray flow. The evaporation process condenses the vapor into liquid 314. The spray water falls onto a fill pack 316 where it is cooled before falling into the sump such as sloping water basin 318. Ambient air is drawn across the fill pack 316 and warm saturated air 320 from the fill pack 316 travels through drift eliminators 322, through the axial fan 312, then up through the dry finned coil 304 where it picks up additional heat. The spray pump 324 recirculates the cooled water to the spray system.

Regarding FIG. 10, when the dry coil bypass damper 310 is fully closed, the plume is totally eliminated and dry capacity is maximized to save water. When the dry coil bypass damper 310 is fully open, the unit airflow and wet performance is maximized to save energy. When the dry coil bypass damper 310 is in a modulated position, i.e., partially opened, the plume may be abated and energy and water are conserved by transferring the heat rejection load between the wet and dry coils.

Figure 11:
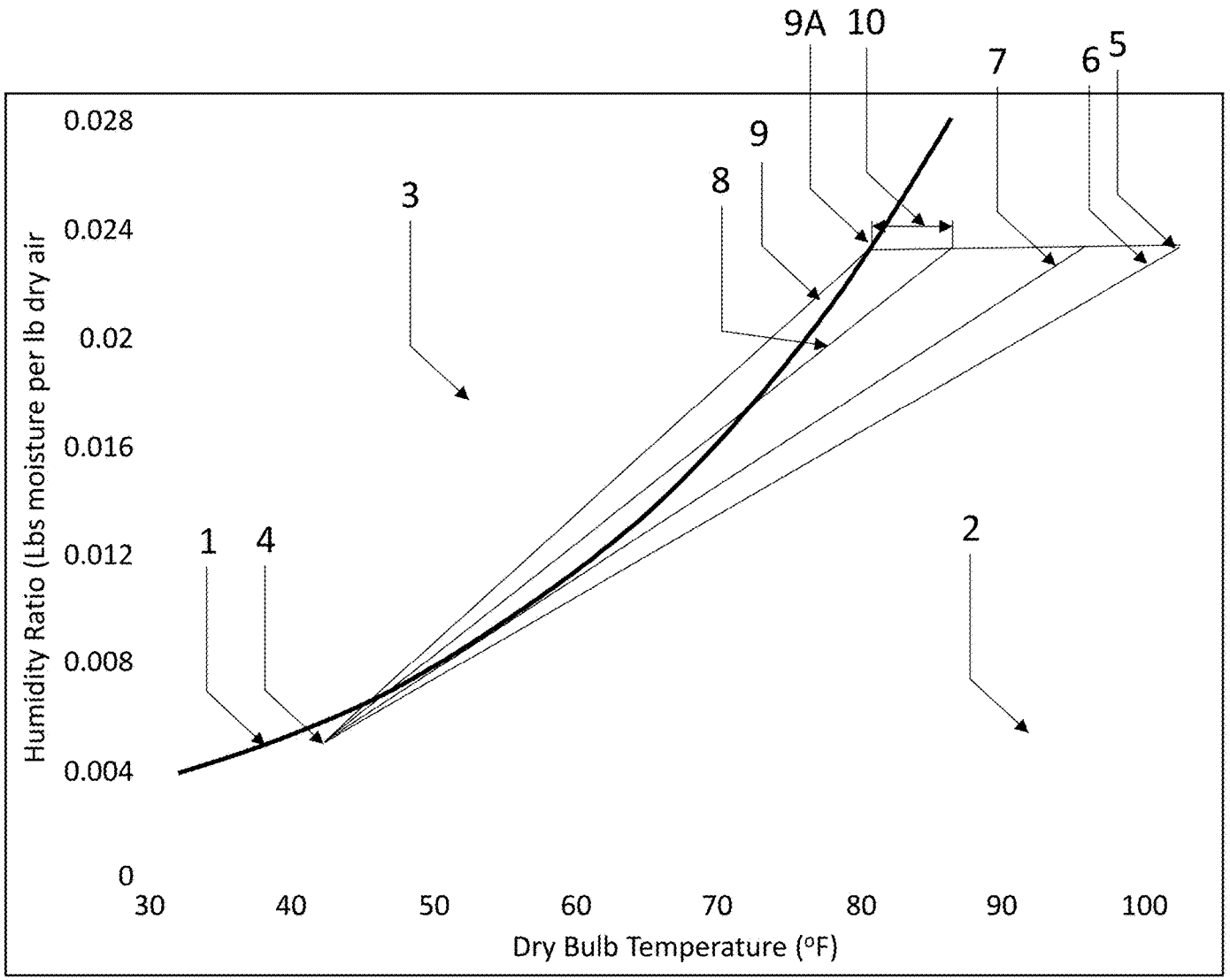
FIG. 11 shows a psychrometric chart showing an example of plume abatement.

Now referring to FIG. 11, the following lines are explained:

1—Saturation curve

2—Superheated air zone

3—Saturated air zone

4—Ambient air state point

5—Representative line joining multiple discharge air state points

6—Mixing line of ambient air and discharge air occurring below saturation curve (no plume line)

7—Mixing line of ambient air and discharge air coinciding with saturation curve (plume onset line);

8—Mixing line of ambient air and discharge air above saturation curve (visible plume onset line);

9—Mixing line of ambient air and discharge air coinciding with saturation curve (typical visible plume line);

9A—Leaving air state point without plume abatement; and

10—Degree of reduction of discharge dry bulb temperature to eliminate visible plume in the case of the typical visible plume line shown (plume visibility factor).

At the air discharge of evaporative cooling equipment, water droplets can be formed by condensation of water vapor in warm humid discharge air by contact with the colder ambient air, at certain ambient temperature conditions. This phenomenon is referred to as plume and occurs when the mixing line joining the ambient and discharge air state points intersects with the saturation curve on the psychrometric chart. The discharge air state point is calculated by adding the air enthalpy pickup as the air traverses through the evaporative cooling equipment to the ambient air enthalpy.

In FIG. 11, four air mixing lines are shown at the same ambient air state and the same discharge humidity ratio. Mixing line 6 is the no plume line since it is below the saturation curve. Mixing line 7 corresponds to the onset of plume and coincides with the saturation line. Any decrease in the discharge air dry bulb temperature for mixing line 7 will result in plume. Mixing line 8 corresponds to the onset of visible plume and overlaps to a small degree the saturation zone 3. Any decrease in the discharge air dry bulb temperature for mixing line 8 will result in visible plume. Mixing line 9 is a typical line at which visible plume occurs. The magnitude by which the discharge air dry bulb temperature should increased to eliminate visible plume is defined as the plume visibility factor 10. The visible plume of a hybrid heat exchanger may be eliminated by subjecting discharge air to a heated dry indirect heat exchanger, e.g., a dry coil, at a constant humidity ratio so that the air is heated to a value equal to or in excess of the plume visibility factor.

One approach for determining whether the discharge air from the evaporative cooling equipment will form a visible plume during a wet mode of operation of the equipment involves calculating the enthalpy of the air entering the evaporative cooling equipment, i.e., the ambient air. The enthalpy of the air entering the evaporative cooling equipment is calculated using the psychrometric function of dry bulb inlet air temperature ($T_{iDB}$), wet bulb inlet air temperature ($T_{iWB}$), and barometric pressure (P):

$$h_i = f(T_{i,DB}, T_{i,WB}, P)$$

The enthalpy of the air entering the evaporative cooling equipment corresponds to ambient air state point 4 in FIG. 11.

Next, the enthalpy of the air leaving the evaporative cooling equipment is calculated. The enthalpy of the air leaving the evaporative cooling equipment is the sum of the entering air enthalpy and the enthalpy picked up by the air in the evaporative cooling equipment:

$$h_e = h_i + \Delta h$$

The enthalpy picked up by the air in the evaporative cooling equipment, i.e., the delta h value in the equation above, is the cooling capacity of the evaporative cooling equipment.

The air leaving an indirect heat exchanger having evaporative cooling liquid being sprayed thereon is typically saturated. Thus, without operation of a plume abatement coil of the evaporative cooling equipment, the air leaving the evaporative cooling equipment may be saturated and have a temperature provided by the psychrometric function:

$$T_{e,DB}=T_{e,WB}=f(h_e, P)$$

The discharge air state point 9A in FIG. 11 is determined by locating the point on the saturation curve 1 that corresponds to the dry bulb ($T_{e,DB}$) temperature at the outlet of the evaporative cooling equipment.

A straight line may be plotted (e.g., line 9 in FIG. 11) on the psychrometric chart to connect the ambient air state point 4 and the discharge air state point 9A.

Next, the data for the line 9 and the saturation curve 1 are analyzed to determine whether there is a plume onset area above the saturation curve 1 and below the line 9.

To determine whether plume formation is occurring, a plume visibility factor is calculated to represent the magnitude by which the discharge air dry bulb temperature should be increased to eliminate visible plume. The plume visibility factor may be determined, for example, by the control system of the evaporative cooling equipment (e.g., control system 61), a building HVAC system controller, a remote computer (e.g., a server computer connected via the internet and customer port 120), and/or a user device such as a cellphone or tablet computer.

The plume visibility factor may be, in effect, the discharge dry bulb temperature offset needed to move the line 9 to the right of line 8 in the psychrometer chart of FIG. 11 The control system compares the plume visibility factor to a threshold such as an operating limit. If the plume visibility factor exceeds the operating limit, the control system causes the bypass (e.g. damper 42) to be in the closed position and operates the dry indirect heat exchanger to raise the temperature of the air leaving the evaporative cooling equipment. The heating of the air by the dry indirect heat exchanger moves the discharge air state point 9A to the right in the graph of FIG. 11 such that the line connecting the points 9, 9A is below the visible plume line 8 to abate the plume.

In response to a plume formation determination, the control system may cause the bypass (e.g. damper 44) to close and may operate the dry indirect heat exchanger (e.g., 12A in FIG. 1) to raise the temperature of the air leaving the evaporative cooling equipment and shift the discharge air state point (e.g., 9A in FIG. 11) to the right in FIG. 11 so that the line connecting the inlet and discharge state points remains under the visible plume line 8. For example, the control system 61 in FIG. 6 may turn on a valve 13 that permits industrial byproduct steam to enter the dry indirect heat exchangers 12A, 12B and raise the temperature of the air leaving the hybrid heat exchanger 60 so that the discharge state point is at point 5 rather than point 9A. The control system 61 may cause the damper 44 to close by checking the position of the damper 44. If the damper 44 is already closed, the control system 61 does not change the position of the damper 44. If the damper 44 is open, the control system 61 closes the damper 44.

The dry indirect heat exchanger 12A, 12B may be configured to provide a fixed or variable amount of heat to the air before the air leaves the hybrid heat exchanger 60. For example, the valve 13 that controls the flow of steam into the dry indirect heat exchanger 12A, 12B may have only a closed configuration with no steam flow and an open configuration that provides a fixed flow rate of steam at a substantially fixed temperature into the dry indirect heat exchanger 12A, 12B. When the control system 118A causes the valve 13 to open, the dry indirect heat exchanger 12A, 12B provides a step-function type heating to the air before air leaves the hybrid heat exchanger 60. In another embodiment, the valve 13 is replaced with a variable speed pump configured to pump hot waste air into the indirect heat exchanger 12A, 12B. The control system 118A may operate the variable speed pump to increase or decrease the flow rate of the hot waste air through the indirect heat exchanger 12A, 12B and effect a corresponding increase or decrease in the amount of heat the indirect heat exchanger 12A, 12B puts into the air before the air leaves the hybrid heat exchanger 12A, 12B.

Figure 12A:
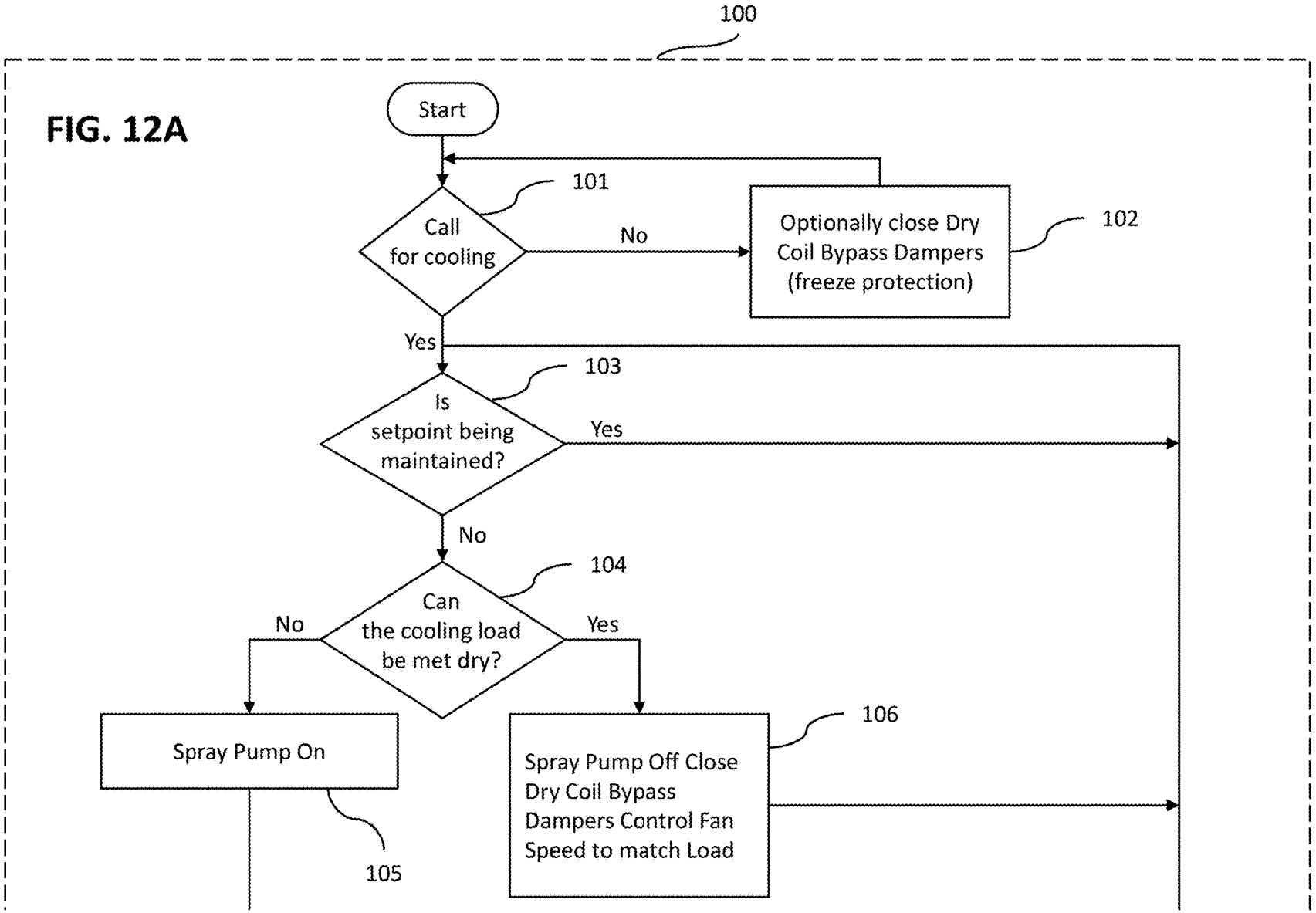
FIGS. 12A, 12B, 12C show control logic that may be used with the heat exchangers of FIGS. 1, 3, 5, 6, 9, 10.
Figure 12B:
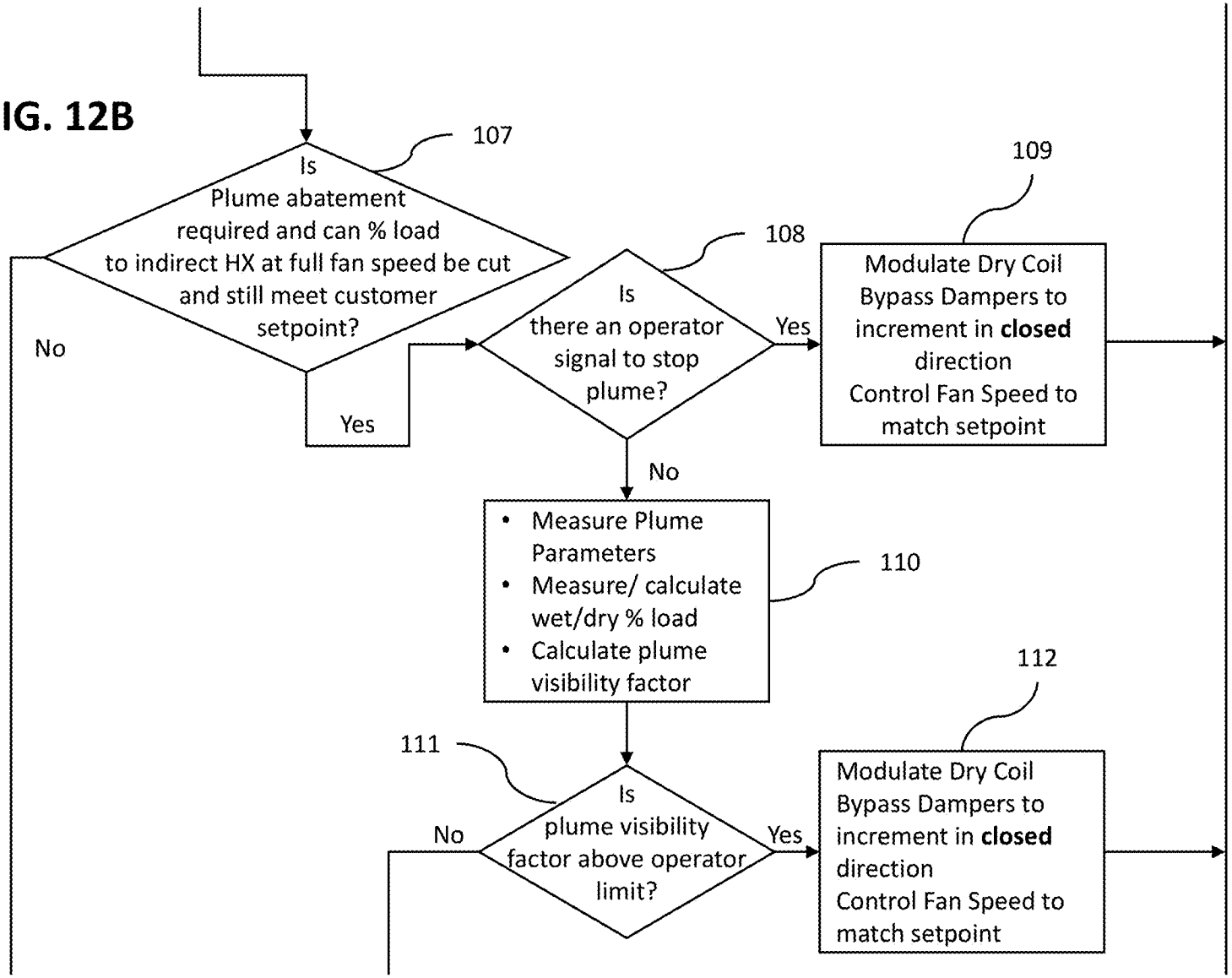
Figure 12C:
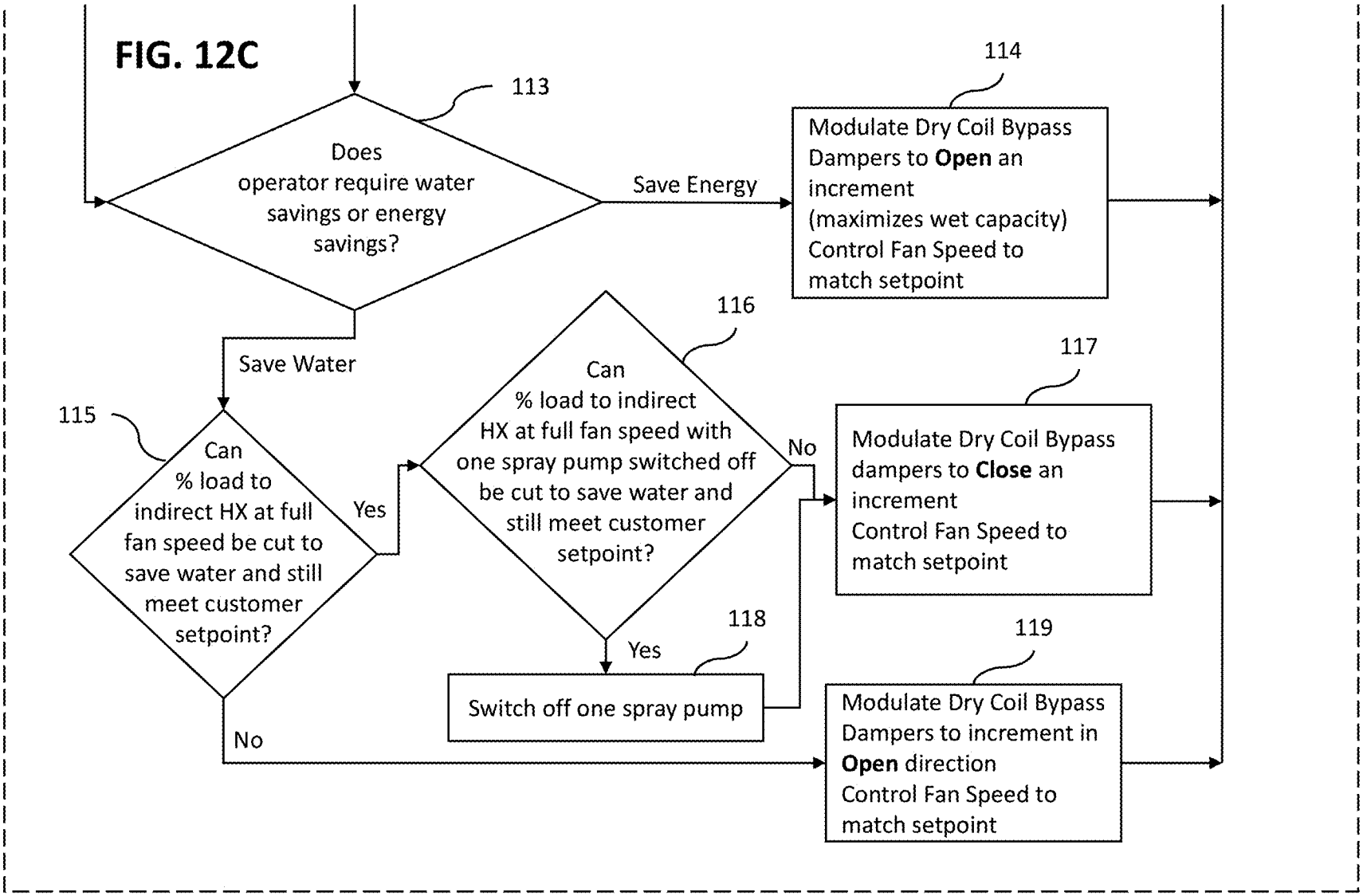

Now referring to FIGS. 12A, 12B, and 12C, the control logic presented addresses dry coil bypass on an evaporatively cooled indirect hybrid heat exchanger (HX) with or without direct heat exchange (HX) where the fluid in the dry coil is either a primary process fluid or an independent hot fluid stream. This logic may be implemented by a control system (e.g. control system 61) to control the embodiments in FIGS. 1, 3, 6, 8, 9 & 10.

The method or control logic 100 is initiated at element 101 when the call for cooling is conveyed to the control system. In the absence of this call, the dry coil bypass dampers may optionally be closed for freeze protection as per 102. If the setpoint is being maintained the control logic does not progress further and is diverted back to the cooling call. If the cooling load can be met by running the unit dry, then the spray pump is kept off and the dry coil bypass dampers stay closed or are set to closed as per 106. The fan speed is controlled to match the required load, and the control logic is diverted back to the cooling call. If the cooling load cannot be met by running the unit dry, the control switches to element 105 at which point the spray pump is switched on.

If plume abatement is required, the plume abatement logic is initiated. However, element 107 overrides the plume abatement logic and diverts to element 113 if any reduction to the heat rejection capability at full fan speed precludes the heat transfer equipment from meeting the setpoint. If the customer has indicated that plume abatement is required, then the dry coil bypass dampers are modulated closed by a preset increment. As explained earlier, this will alter the discharge air condition to reduce or eliminate plume. The fan speed is controlled to match the required setpoint, and the control logic is diverted back to the cooling call as per 109. If the operator does not indicate the need for plume abatement, element 110 acquires data that allows it to determine the occurrence of plume. The data collected pertains to the heat rejected by the equipment, which is translated to the enthalpy pickup of the air to calculate the discharge air state. The discharge air state is utilized to generate the air mixing line and to calculate the plume visibility factor. If the plume visibility factor exceeds the preset value, plume abatement is required. The dry coil bypass dampers are then modulated closed by a preset increment, the fan speed is controlled to match the required setpoint, and the control logic is diverted back to the cooling call as per 112.

In some embodiments, the heat exchanger may include a plume detection sensor configured to detect the presence of a plume. The plume abatement logic may initiate plume abatement in response to the plume detection sensor detecting a plume from the heat exchanger even if the plume visibility factor does not exceed the preset value. As another example, the plume abatement logic may initiate plume abatement only if the plume visibility factor exceeds the preset value and the plume detection sensor detects a plume.

If plume abatement is not required or if the plume abatement logic has been executed, the control at 113 diverts the logic to either save water or save energy. To save energy, the dry coil bypass dampers are then modulated open by a preset increment, the fan speed is controlled to match the required setpoint, and the control logic is diverted back to the cooling call as per 114. Along the water savings logic path, if reduction of the cooling capacity of the indirect heat exchanger (HX) at full fan speed precludes the equipment to meet the operator setpoint, then element 119 is initiated. If not, then element 116 comes into effect. At element 119, the dry coil bypass dampers are modulated open by a preset increment, the fan speed is controlled to match the required setpoint, and the control logic is diverted back to the cooling call. At element 116, if reduction of the cooling capacity of the indirect HX coil at full fan speed with one spray pump switched off precludes the equipment to meet the operator setpoint, then element 117 is initiated. If not, then element 118 comes into effect. At element 117, the dry coil bypass dampers are modulated closed by a preset increment, the fan speed is controlled to match the required setpoint, and the control logic is diverted back to the element 103. At element 118, one spray pump is switched off, and the control is set to element 117.

Figure 13A:
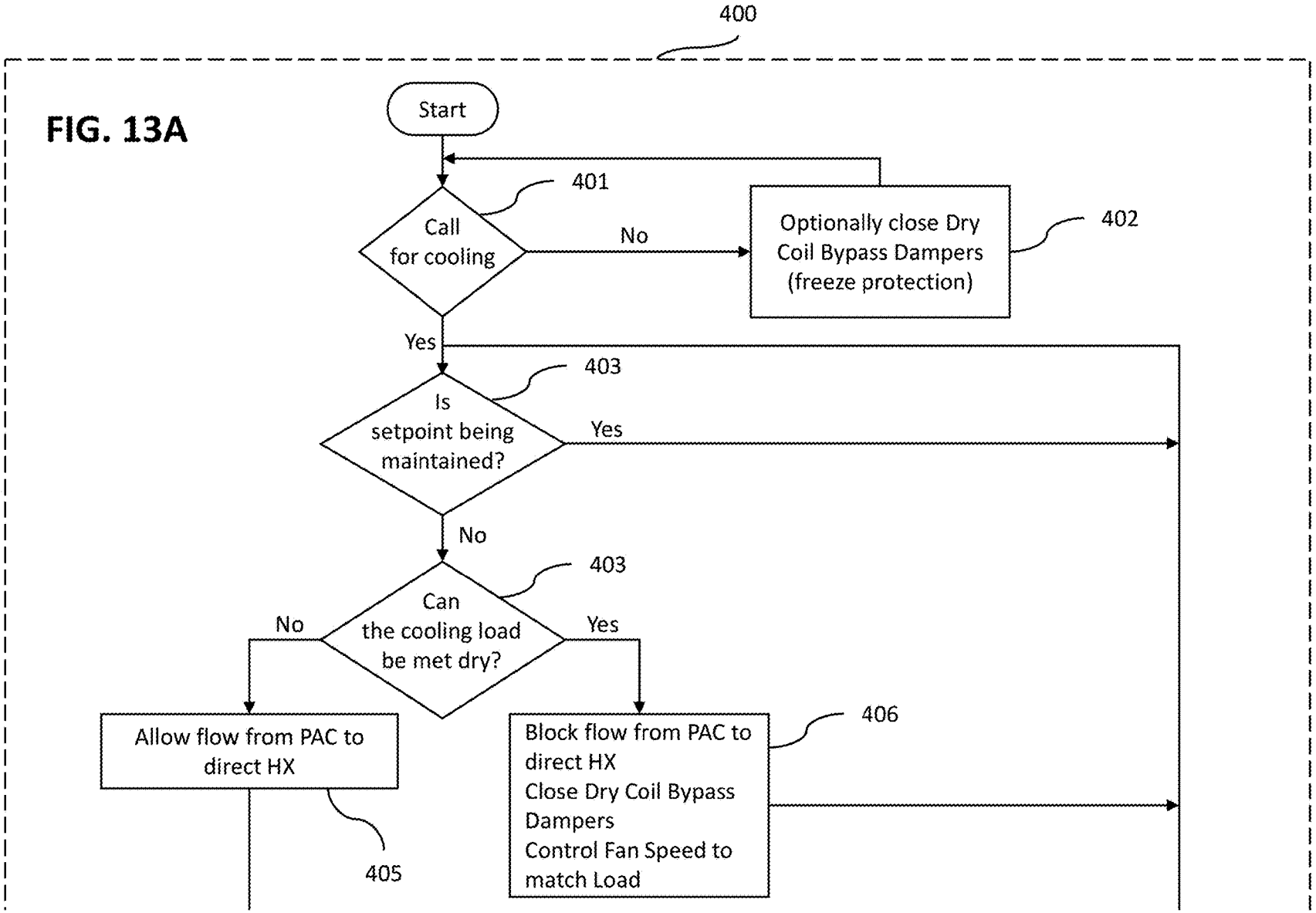
FIGS. 13A, 13B, 13C show control logic that may be used with the heat exchangers of FIGS. 7 and 8.
Figure 13B:
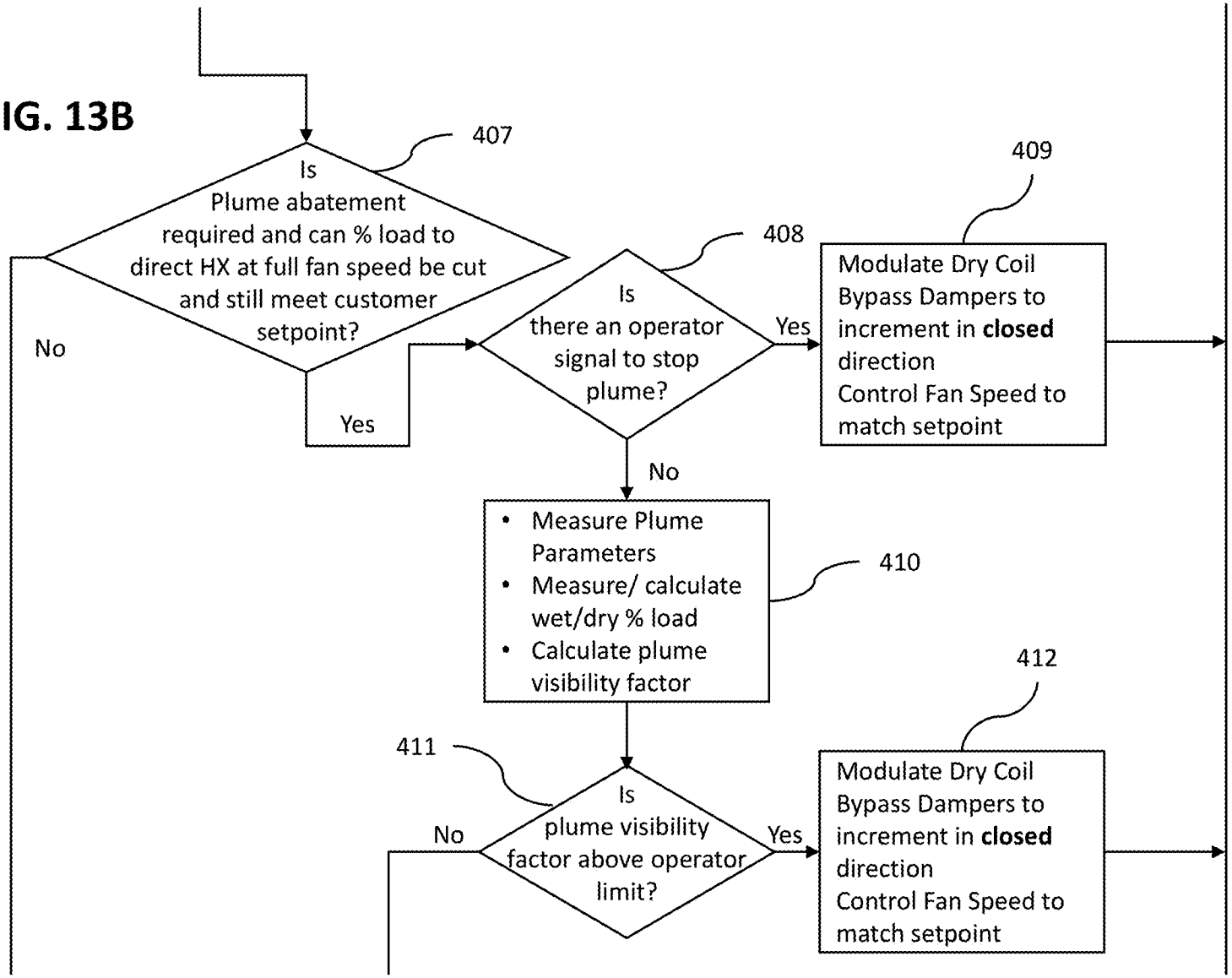
Figure 13C:
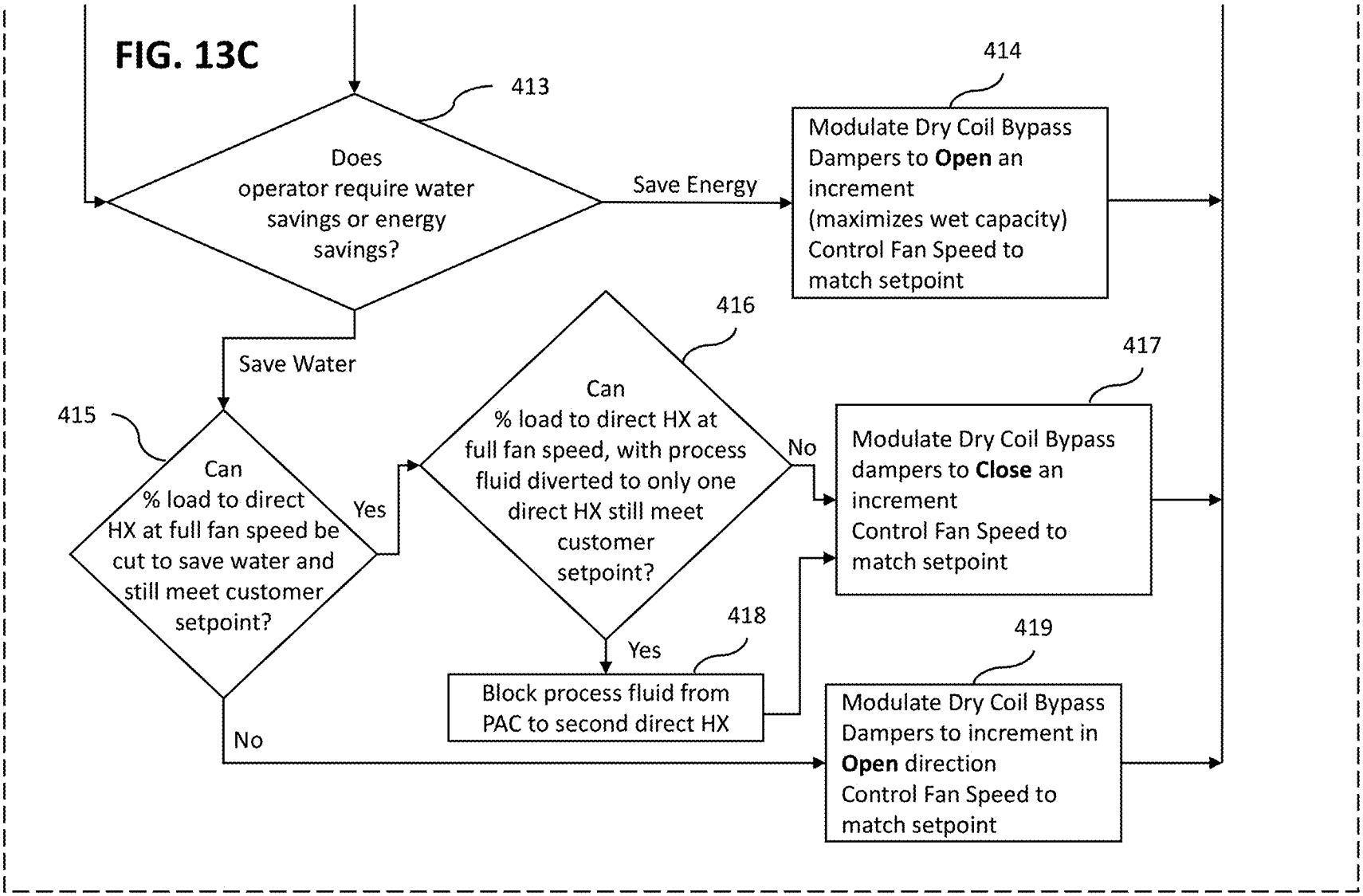

Now referring to FIGS. 13A, 13B, and 13C, a method as described by control logic 400 may be used to operate dry coil bypass on an evaporatively cooled direct heat exchanger ("HX") where the fluid in the dry coil is the primary process fluid. This control logic may be utilized by a control system to operate the hybrid heat exchanger of FIG. 7.

The control logic 400 is initiated at element 401 when the call for cooling is conveyed to the control system. In the absence of this call, the dry coil bypass dampers can optionally be closed for freeze protection as per 402. If the setpoint is being maintained, the control logic does not progress further and is diverted back to the cooling call. If the cooling load can be met by running the unit dry, then the process fluid flow from the plume abatement coil (PAC) (such as dry indirect heat exchangers 12A, 12B) to the direct HX (such as direct heat exchanger 115A) is blocked and the dry coil bypass dampers stay closed or are set to closed as per 406. The fan speed is controlled to match the required load, and the control logic is diverted back to the cooling call. If the cooling load cannot be met by running the unit dry, the control switches to element 405 at which point the process fluid flow is allowed to travel from the PAC to the direct HX.

If plume abatement is required at element 407, the plume abatement logic is initiated. However, element 407 overrides the plume abatement logic and diverts it to element 413 if any reduction to the heat rejection capability at full fan speed precludes the heat transfer equipment from meeting the setpoint. If the customer has indicated that plume abatement is required, then the dry coil bypass dampers are modulated closed by a preset increment. The fan speed is controlled to match the required setpoint, and the control logic is diverted back to the cooling call as per 409. If the operator does not indicate the need for plume abatement, element 410 acquires data that allows it to determine the occurrence of plume. If the plume visibility factor exceeds the preset value, plume abatement is required. The preset value may be, for example, in the range of one to ten degrees, such as three to eight degrees, such as five degrees. The dry coil bypass dampers are then modulated closed by a preset increment, the fan speed is controlled to match the required setpoint, and the control logic is diverted back to the cooling call as per 412.

If plume abatement is not required or if the plume abatement logic has been executed, the control at 413 diverts the logic to either save water or save energy. To save energy, the dry coil bypass dampers are then modulated open by a preset increment, the fan speed is controlled to match the required setpoint, and the control logic is diverted back to the cooling call as per 414. Along the water savings logic path, if reduction of the cooling capacity of the direct heat exchanger at full fan speed precludes the equipment to meet the operator setpoint, then element 419 is initiated. If not, then element 416 comes into effect. At element 419, the dry coil bypass dampers are modulated open by a preset increment, the fan speed is controlled to match the required setpoint, and the control logic is diverted back to the cooling call. At element 416, if reduction of the cooling capacity of the direct HX coil at full fan speed, with process fluid diverted to only one direct HX precludes the equipment to meet the operator setpoint, then element 417 is initiated. If not, then element 418 comes into effect. At element 417, the dry coil bypass dampers are modulated closed by a preset increment, the fan speed is controlled to match the required setpoint, and the control logic is diverted back to the cooling call. At element 418, the process fluid flow from the PAC to one direct HX is blocked, and the control is set to element 417.

Now referring to FIG. 14, a method as described by control logic 500 is provided to control dry coil bypass on an evaporatively cooled direct HX where the fluid in the dry coil is an independent hot fluid stream and is not the process fluid. The control logic 500 may be utilized by a control system to operate the hybrid heat exchanger of FIG. 7 or 8.

The control logic 500 is initiated at element 501 when the call for cooling is conveyed to the control system. In the absence of this call the dry coil bypass dampers can optionally be closed for freeze protection as per 502. If the setpoint is being maintained the control logic does not progress further and is diverted back to the cooling call. If plume abatement is required, the plume abatement logic is initiated. However, element 504 overrides the plume abatement logic and diverts it to element 510 if any reduction to the heat rejection capability at full fan speed precludes the heat transfer equipment from meeting the setpoint. If the customer has indicated that plume abatement is required, then the dry coil bypass dampers are modulated closed by a preset increment. The fan speed is controlled to match the required setpoint, and the control logic is diverted back to the cooling call as per 506. If the operator does not indicate the need for plume abatement, element 507 acquires data that allows it to determine the occurrence of plume. If the plume visibility factor exceeds the preset value, plume abatement is required. The dry coil bypass dampers are then modulated closed by a preset increment, the fan speed is controlled to match the required setpoint, and the control logic is diverted back to the cooling call as per 109.

If plume abatement is not required or if the plum abatement logic has been executed, the control again is led to element 510. At element 510, the dry coil bypass dampers are opened fully, the fan speed is controlled to match the required setpoint, and the control logic is diverted back to the cooling call.

Figure 15B:
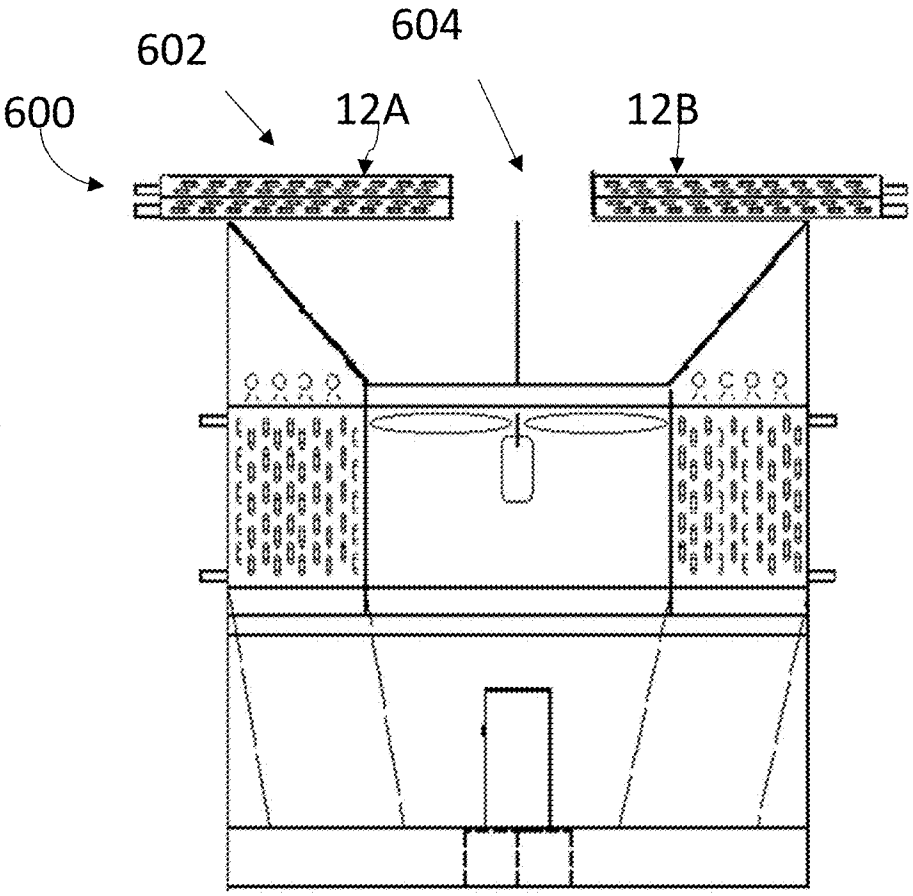
FIGS. 15A and 15B show a hybrid evaporative heat exchanger having a wet indirect heat exchanger and a dry indirect heat exchanger having portions that may be shifted apart to permit air to bypass the dry indirect heat exchangers.
Figure 15A:
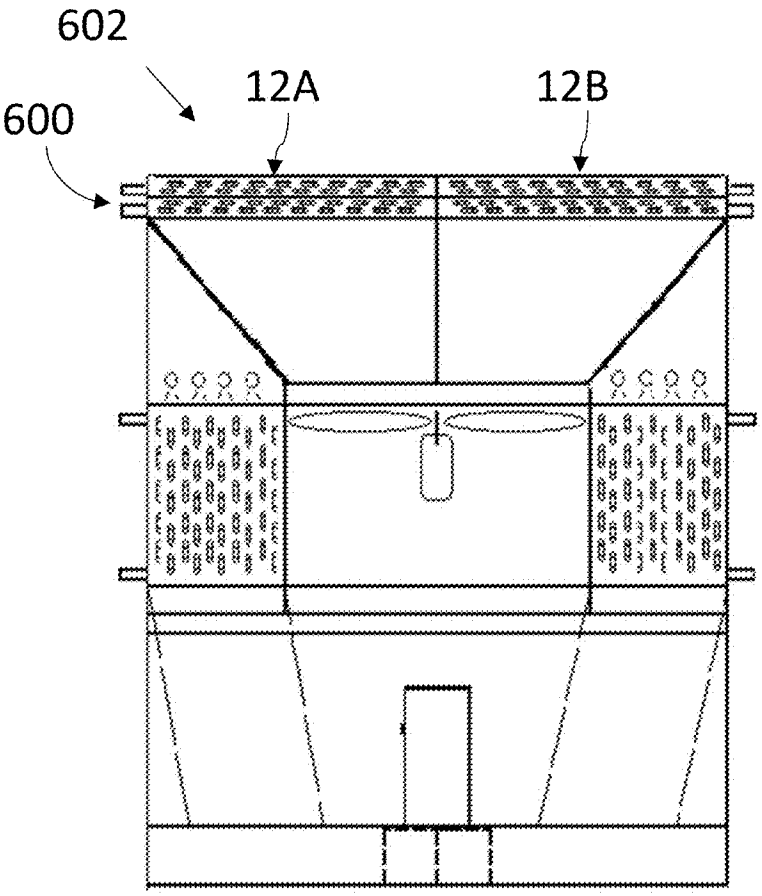

Regarding FIG. 15A, a hybrid heat exchanger 600 is provided that is similar in many respects to the heat exchangers discussed above. The hybrid heat exchanger 600 includes a plume abatement assembly 602 including dry indirect heat exchangers 12A, 12B. The plume abatement assembly 602 is shown in an operative configuration wherein the dry indirect heat exchangers 12A, 12B are adjacent one another such that airflow in the hybrid heat exchanger 600 must travel through the dry indirect heat exchangers 12A, 12B before leaving the hybrid heat exchanger 600. In FIG. 15B, the plume abatement assembly 602 is shown in a bypass configuration wherein the dry indirect heat exchangers 12A, 12B are spaced apart by an opening 604. The opening 604 permits at least a portion of the airflow in the hybrid heat exchanger 600 to exit the hybrid heat exchanger 600 without traveling through the dry indirect heat exchangers 12A, 12B. The hybrid heat exchanger 600 may include one or more motor, such as linear actuators, that are operated by a control system of the hybrid heat exchanger 600 to shift the dry indirect heat exchangers 12A, 12B between the closed and open positions of FIGS. 15A and 15B.

Figure 16B:
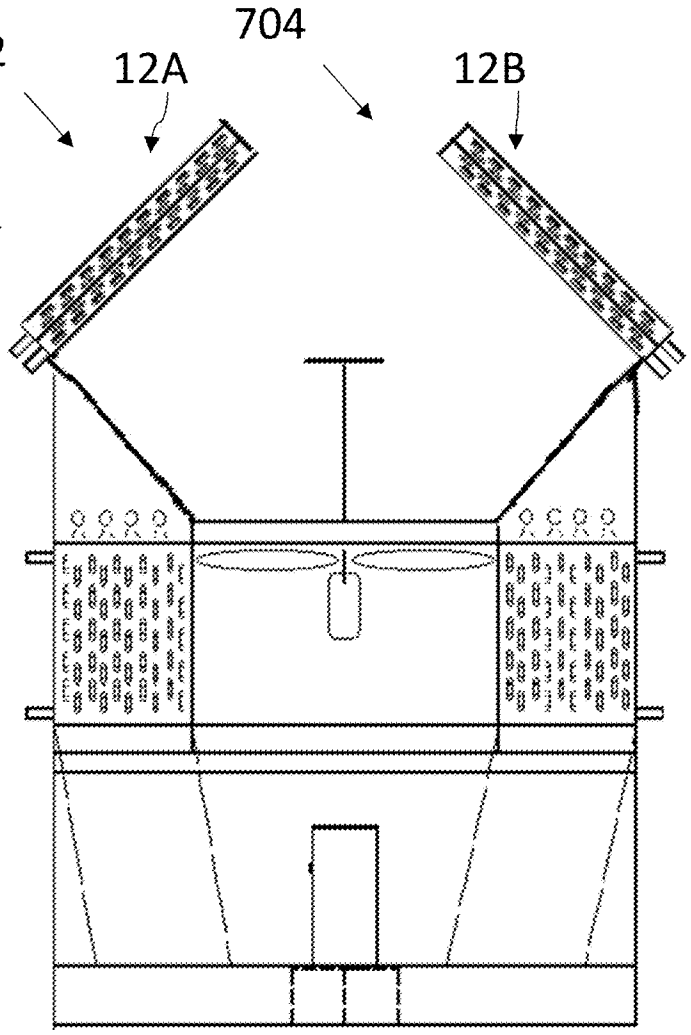
FIGS. 16A and 16B show a hybrid evaporative heat exchanger having a wet indirect heat exchanger and a dry indirect heat exchanger having portions may be pivoted apart to permit air to bypass the dry indirect heat exchangers.
Figure 16A:
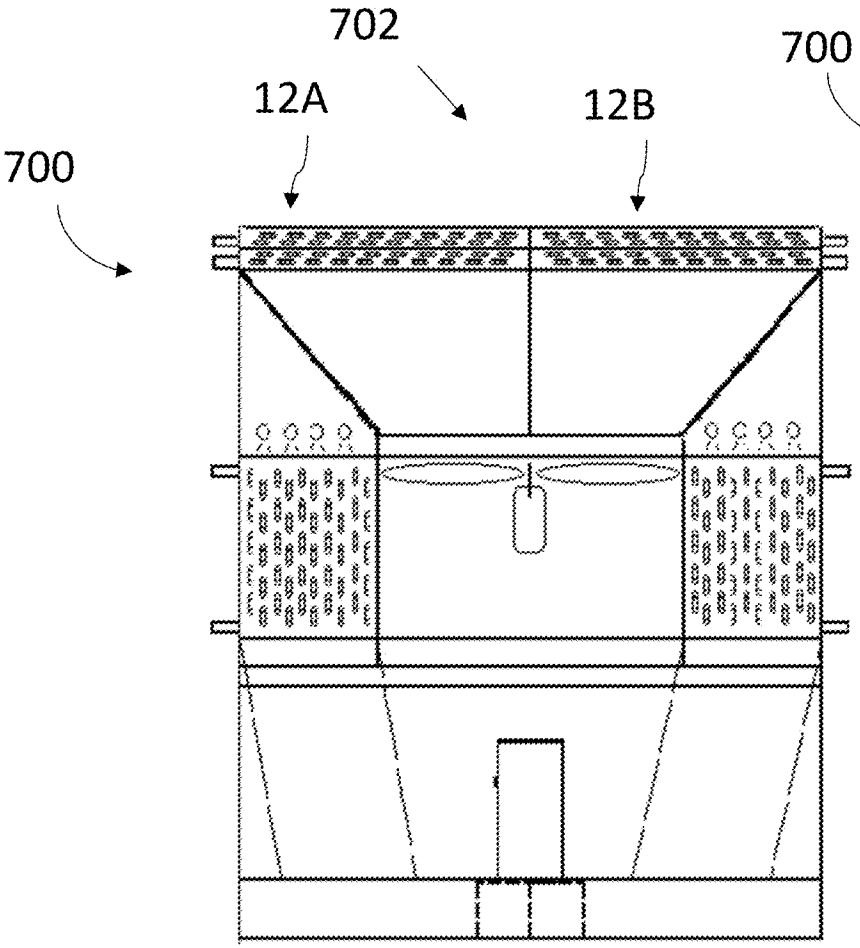

Regarding FIG. 16A, a hybrid heat exchanger 700 is provided that is similar in many respects to the heat exchangers discussed above. The hybrid heat exchanger 700 includes a plume abatement assembly 602 including dry indirect heat exchangers 12A, 12B. In FIG. 16, the plume abatement heat exchanger 602 is in an operative configuration wherein the dry indirect heat exchangers 12A, 12B are adjacent one another such that airflow in the hybrid heat exchanger 700 must travel through the dry indirect heat exchangers 12A, 12B. In FIG. 16B, the plume abatement assembly 702 is in a bypass configuration wherein the dry indirect heat exchangers 12A, 12B are pivoted up relative to one another to form an opening 704 that permits at least a portion of the airflow in the hybrid heat exchanger 700 to exit the hybrid heat exchanger 700 without traveling through the dry indirect heat exchangers 12A, 12B.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass only A, only B, or both A and B.

While there have been illustrated and described particular embodiments of the present invention, it will be appreciated that numerous changes and modifications will occur to those skilled in the art, and it is intended for the present invention to cover all those changes and modifications which fall within the scope of the appended claims.

What is claimed is:

1. A hybrid evaporative heat exchange system comprising:

a wet heat exchanger;

at least one fan configured to generate airflow relative to the wet heat exchanger;

a dry heat exchanger assembly downstream of the wet heat exchanger, the dry heat exchanger assembly including a dry heat exchanger configured to raise a temperature of the airflow from the wet heat exchanger;

the dry heat exchanger assembly having an operative configuration wherein the airflow from the wet heat exchanger flows through the dry heat exchanger and a bypass configuration wherein less of the airflow from the wet heat exchanger travels through the dry heat exchanger than when the dry heat exchanger assembly is in the operative configuration;

a control system operatively coupled to the wet heat exchanger, the at least one fan, and the dry heat exchanger assembly, the control system configured to cause the dry heat exchanger assembly to be in the plume abatement configuration in response to a determination of plume formation to permit the dry heat exchanger to raise the temperature of the airflow;

wherein the control system is configured to receive either a request to save energy or a request to save water;

wherein, in the absence of the determination of plume formation, the control system is configured to:

operate the wet heat exchanger and the dry heat exchanger assembly to limit energy consumption in response to receiving the request to save energy; and operate the wet heat exchanger and the dry heat exchanger assembly to limit evaporated liquid usage in response to receiving the request to save water.

2. The hybrid evaporative heat exchange system of claim 1 wherein the control system has a dry mode wherein the control system limits operation of the wet heat exchanger and a wet mode wherein the control system operates the wet heat exchanger; and wherein the control system, in the wet mode thereof, is configured to cause the dry heat exchanger assembly to be in the bypass configuration unless there is a plume formation determination.

3. The hybrid evaporative heat exchange system of claim 1 wherein the control system is configured to calculate a first state associated with air upstream of the wet heat exchanger and a second state associated with air downstream of the dry heat exchanger; and wherein the control system is configured to determine plume formation in response to the first and second states having a predetermined relationship with the ambient air.

4. The hybrid evaporative heat exchanger system of claim 3 wherein the control system is configured to determine the first and second states having the predetermined relationship with ambient air based at least in part upon a plume visibility factor exceeding a threshold.

5. The hybrid evaporative heat exchanger system of claim 3 wherein the control system is configured to determine the first and second states having the predetermined relationship with ambient air based at least in part upon the airflow temperature increase provided by the dry heat exchanger being substantially equal to or exceeding a temperature increase required to cause the first and second states to no longer have the predetermined relationship with the ambient air.

6. The hybrid evaporative heat exchange system of claim 1 wherein the control system has an input configured to receive data indicative of at least one parameter of air upstream of the wet heat exchanger or downstream of the dry heat exchanger;

wherein the control system is configured to:

determine a first state of the air upstream of the wet heat exchanger and a second state of the air downstream of the dry heat exchanger using psychrometric chart data;

identify a linear relationship connecting the first and second states in the psychrometric chart data and identifying whether the linear relationship is beyond a plume onset line of the psychrometric chart data; and determine plume formation in response to the identification of the linear relationship being beyond the plume onset line of the psychometric chart data.

7. The hybrid evaporative heat exchange system of claim 1 wherein the control system includes an input configured to receive a request for plume abatement; and wherein the control system is configured to determine plume formation in response to the input of the control system receiving the request for plume abatement.

8. The hybrid evaporative heat exchange system of claim 1 wherein the dry heat exchanger assembly in the operative configuration has an opening that is closed or partially open; and wherein, in the bypass configuration, the dry heat exchanger assembly opening is more open than the opening in the operative configuration of the dry heat exchanger assembly.

9. The hybrid evaporative heat exchange system of claim 1 wherein the control system, in response to the determination of plume formation, is configured to cause the dry heat exchanger assembly to be in the plume abatement configuration including:

determining whether the dry heat exchanger assembly is in the operative configuration or the bypass configuration; and upon the dry heat exchanger assembly being in the bypass configuration, reconfiguring the dry heat exchanger assembly to the operative configuration in response to the plume formation determination.

10. The hybrid evaporative heat exchange system of claim 1 further comprising a sensor configured to detect at least one air parameter; and the control system configured to use the at least one air parameter to determine plume formation.

11. The hybrid evaporative heat exchange system of claim 1 wherein the control system has a dry mode wherein the control system does not operate the wet heat exchanger and causes the dry heat exchanger assembly to be in the operative configuration thereof.

12. The hybrid evaporative heat exchange system of claim 1 wherein the wet heat exchanger includes at least one of a direct evaporative heat exchanger and an indirect evaporative heat exchanger.

13. The hybrid evaporative heat exchanger system of claim 1 further comprising a plume detector operatively coupled to the control system; and wherein the control system is configured to determine plume formation in response to a signal from the plume detector indicating a plume.

14. A method of operating a hybrid evaporative heat exchanger having a wet heat exchanger and a plume abatement assembly downstream of the wet heat exchanger, the plume abatement assembly including a dry heat exchanger configured to raise a temperature of airflow from the wet heat exchanger, the plume abatement assembly having an operative configuration wherein the airflow from the wet heat exchanger flows through the dry heat exchanger and a bypass configuration wherein less of the airflow from the wet heat exchanger travels through the dry heat exchanger than when the plume abatement assembly is in the operative configuration, the method comprising:

receiving either a request to save energy or a request to save water;

operating the wet heat exchanger;

determining whether there is plume formation;

upon plume formation:

causing the plume abatement assembly to be in the operative configuration; and raising the temperature of the airflow via the dry heat exchanger of the plume abatement assembly before the airflow leaves the hybrid evaporative heat exchanger to abate plume formation; and in the absence of plume formation:

operating the wet heat exchanger and the plume abatement assembly to limit energy consumption in response to receiving the request to save energy; and operating the wet heat exchanger and the plume abatement assembly to limit evaporative liquid usage in response to receiving the request to save water.

15. The method of claim 14 further comprising:

calculating a first state associated with air upstream of the wet heat exchanger and a second state of air downstream of the dry heat exchanger; and determining plume formation in response to the first and second states having a predetermined relationship with the ambient air.

16. The method of claim 15 wherein determining plume formation in response to the first and second states having a predetermined relationship with ambient air includes determining the predetermined relationship based at least in part upon a plume visibility factor exceeding a threshold.

17. The method of claim 15 wherein determining plume formation in response to the first and second states having a predetermined relationship with the ambient air includes:

determining the first and second states having the predetermined relationship with the ambient air based at least in part upon the airflow temperature increase provided by the dry heat exchanger being substantially equal to or exceeding a temperature increase required to cause the first and second states to no longer have the predetermined relationship with the ambient air.

18. The method of claim 14 wherein determining plume formation includes:

receiving data indicative of at least one parameter of air upstream of the wet heat exchanger or downstream of the dry heat exchanger;

determining a first state of the air upstream of the wet heat exchanger and a second state of the air downstream of the dry heat exchanger using psychrometric chart data;

identifying a linear relationship connecting the first and second states in the psychrometric chart data and identifying whether the linear relationship is beyond a plume onset line of the psychrometric chart data; and determining plume formation in response to the identification of the linear relationship being beyond the plume onset line of the psychometric chart data.

19. The method of claim 14 wherein determining plume formation includes receiving, at a control system of the hybrid evaporative heat exchanger, a request for plume abatement.

20. The method of claim 14 wherein causing the plume abatement assembly to be in the operative configuration includes reconfiguring the plume abatement assembly from the bypass configuration to the operative configuration.

21. The method of claim 20 wherein reconfiguring the plume abatement assembly from the bypass configuration to the operative configuration includes making an opening of the plume abatement assembly smaller than the opening was in the bypass configuration.

22. The method of claim 14 wherein causing the plume abatement assembly to be in the operative configuration includes modulating a closure member of the plume abatement assembly to change the size of an opening of the plume abatement assembly.

23. The hybrid evaporative heat exchanger system of claim 1 wherein the request includes a request to save energy during a first time period and a request to save water during a second time period;

wherein the control system is configured to operate the wet heat exchanger and the dry heat exchanger assembly to limit energy consumption during the first time period; and wherein the control system is configured to operate the wet heat exchanger and the dry heat exchange assembly to limit evaporative liquid usage during the second time period.

24. The hybrid evaporative heat exchanger system of claim 1 wherein the wet heat exchanger includes an indirect heat exchanger, an evaporative liquid distribution system configured to distribute evaporative liquid onto the indirect heat exchanger, a sump to collect evaporative liquid from the indirect heat exchanger, and a pump configured to pump evaporative liquid from the sump to the evaporative liquid distribution system; and wherein the control system is configured to operate the wet heat exchanger and the dry heat exchanger assembly to limit evaporative liquid usage including reducing a flow rate of the pump.

25. The hybrid evaporative heat exchanger system of claim 24 wherein the control system is configured to operate the wet heat exchanger and the dry heat exchanger to limit energy usage including increasing the flow rate of the pump.

26. The hybrid evaporative heat exchanger system of claim 1 wherein the control system, in response to the absence of the determination of plume formation and receiving the request to save water, is configured to cause the dry heat exchanger assembly to be in the plume abatement configuration.

27. The hybrid evaporative heat exchanger system of claim 1 wherein the control system is configured to operate the wet heat exchanger and the dry heat exchanger assembly to limit evaporative liquid usage including limiting operation of the wet heat exchanger.

28. The hybrid evaporative heat exchanger system of claim 1 wherein the control system is configured to operate the wet heat exchanger and the dry heat exchanger assembly to limit energy consumption including limiting operation of the dry heat exchanger.

29. The hybrid evaporative heat exchanger system of claim 1 wherein the control system, in response to the absence of the determination of plume formation and receiving the request to save water, is configured to:

reduce usage of evaporative liquid by the wet heat exchanger upon a determination that the hybrid evaporative heat exchanger system is able to meet a process fluid setpoint with reduced evaporative liquid usage by the wet heat exchanger.

30. The method of claim 14 wherein receiving the request includes receiving a request to save energy during a first time period and a request to save water during a second time period; and wherein operating the wet heat exchanger and the plume abatement assembly to limit energy consumption includes operating the wet heat exchanger and the plume abatement assembly to limit energy consumption during the first time period; and wherein operating the wet heat exchanger and the plume abatement assembly to limit evaporative liquid usage includes operating the wet heat exchanger and the plume abatement assembly to limit evaporative liquid usage during the second time period.

31. The method of claim 14 wherein the wet heat exchanger includes an indirect heat exchanger, an evaporative liquid distribution system configured to distribute evaporative liquid onto the indirect heat exchanger, a sump to collect evaporative liquid from the indirect heat exchanger, and a pump configured to pump evaporative liquid from the sump to the evaporative liquid distribution system; and wherein operating the wet heat exchanger and the plume abatement assembly to limit evaporative liquid usage includes reducing a flow rate of the pump.

32. The method of claim 31 wherein operating the wet heat exchanger and the plume abatement assembly to limit energy usage includes increasing the flow rate of the pump.

33. The method of claim 14 wherein operating the wet heat exchanger and the plume abatement assembly to limit evaporative liquid usage includes the plume abatement assembly being in the bypass configuration.

34. The method of claim 14 wherein operating the wet heat exchanger and the plume abatement assembly to limit evaporative liquid usage includes limiting operation of the wet heat exchanger.

35. The method of claim 14 wherein operating the wet heat exchanger and the plume abatement assembly to limit energy consumption includes limiting operation of the dry heat exchanger.

36. The method of claim 14 further comprising:

determining whether the hybrid evaporative heat exchanger is able to meet a process fluid setpoint with reduced evaporative liquid usage by the wet heat exchanger; and reducing usage of evaporative liquid by the wet heat exchanger in response to the request to save water, the determination of plume formation, and a determination that the hybrid evaporative heat exchanger is able to meet the process fluid setpoint with reduced evaporative liquid usage by the wet heat exchanger.

* * * * *